US008006590B2

(12) United States Patent
Light et al.

(10) Patent No.: US 8,006,590 B2
(45) Date of Patent: Aug. 30, 2011

(54) OPEN-FACED ROD SPINNER

(75) Inventors: Trevor Lyndon Light, Sandy, UT (US); Emil Kolev, Noarlunga Downs (AU); Michael Andreas Kontou, Netley (AU)

(73) Assignee: Longyear TM, Inc., South Jordan, UT (US)

( * ) Notice: Subject to any disclaimer, the term of this patent is extended or adjusted under 35 U.S.C. 154(b) by 137 days.

(21) Appl. No.: 12/464,707

(22) Filed: May 12, 2009

(65) Prior Publication Data

US 2009/0277308 A1 Nov. 12, 2009

Related U.S. Application Data

(60) Provisional application No. 61/052,577, filed on May 12, 2008.

(51) Int. Cl.
*E21B 19/00* (2006.01)
*E21B 19/16* (2006.01)

(52) U.S. Cl. ..... 81/57.15; 81/57.18; 81/57.2; 81/57.35

(58) Field of Classification Search ..... 81/57.15, 81/57.16, 57.18, 57.2, 57.33, 57.34, 57.35
See application file for complete search history.

(56) References Cited

U.S. PATENT DOCUMENTS

| | | | | |
|---|---|---|---|---|
| 430,994 | A | 6/1890 | Ely | |
| 621,293 | A | 3/1899 | Crass | |
| 712,253 | A | 10/1902 | Brwon et al. | |
| 1,416,685 | A | 5/1922 | Bufford | |
| 2,633,045 | A | 3/1953 | Benjamin | |
| 2,650,070 | A * | 8/1953 | Lundeen | 81/57.18 |
| 2,921,489 | A | 1/1960 | Schweitzer | |
| 2,928,301 | A | 3/1960 | Beeman | |
| 2,933,961 | A * | 4/1960 | Adams | 81/57.2 |
| 2,989,880 | A * | 6/1961 | Hesser et al. | 81/57.18 |
| 3,880,024 | A | 4/1975 | Asada | |
| 3,892,140 | A | 7/1975 | Fox et al. | |
| 4,079,640 | A | 3/1978 | Golden | |
| 4,212,212 | A | 7/1980 | Chandler et al. | |
| 4,221,269 | A | 9/1980 | Hudson | |
| 4,324,157 | A | 4/1982 | Soutsos | |
| 4,485,697 | A * | 12/1984 | Heilhecker et al. | 81/57.2 |

(Continued)

FOREIGN PATENT DOCUMENTS

AU 2008296490 2/2011

(Continued)

OTHER PUBLICATIONS

Office Action dated Jan. 21, 2011 from U.S. Appl. No. 12/197,817, filed Aug. 25, 2008 (7 pages).

(Continued)

*Primary Examiner* — Hadi Shakeri
(74) *Attorney, Agent, or Firm* — Workman Nydegger

(57) ABSTRACT

An open-faced rod-spinning device configured for making and/or breaking joints between threaded drill rods. The rod-spinning device may include a drive gear with an open face. The drive gear may also be coupled to a plurality of drive pins. The rod-spinning device may include a carriage assembly including an open face for receiving and rotating about a drill rod. The carriage assembly may include a plurality of gripping lobes configured to be engaged and rotated by the drive pins about pivot pins. The drive gear may be configured to rotate relative to the carriage assembly to cause the drive pins to engage and rotate the gripping lobes.

35 Claims, 15 Drawing Sheets

U.S. PATENT DOCUMENTS

| | | | | |
|---|---|---|---|---|
| 4,512,216 | A | 4/1985 | Callegari, Sr. et al. | |
| 4,604,922 | A | 8/1986 | Soutsos | |
| 4,683,962 | A | 8/1987 | True | |
| 4,694,712 | A | 9/1987 | Doss | |
| 4,765,401 | A | 8/1988 | Boyadjieff | |
| 4,843,924 | A | 7/1989 | Hauk | |
| 4,885,963 | A | 12/1989 | Nishikawa | |
| 4,895,056 | A | 1/1990 | Schulze-Beckinghausen | |
| 5,054,550 | A | 10/1991 | Hodge | |
| 5,060,542 | A | 10/1991 | Hauk | |
| 5,092,411 | A | 3/1992 | Hausherr et al. | |
| 5,207,128 | A | 5/1993 | Albright | |
| 5,320,021 | A | 6/1994 | Heintz | |
| 5,660,087 | A | 8/1997 | Rae | |
| 5,845,549 | A | 12/1998 | Bouligny | |
| 5,868,045 | A | 2/1999 | Hauk | |
| 5,931,231 | A | 8/1999 | Mock | |
| 6,050,156 | A * | 4/2000 | Buck | 81/57.15 |
| 6,070,500 | A | 6/2000 | Dlask et al. | |
| 6,082,225 | A | 7/2000 | Richardson | |
| 6,318,199 | B1 | 11/2001 | Buck | |
| 6,634,443 | B1 | 10/2003 | Paech et al. | |
| 6,910,402 | B2 | 6/2005 | Drzewiecki | |
| 6,971,283 | B2 | 12/2005 | Belik | |
| 7,000,502 | B2 | 2/2006 | Belik | |
| 7,117,938 | B2 | 10/2006 | Hamilton et al. | |
| 7,188,547 | B1 | 3/2007 | West et al. | |
| 7,191,686 | B1 | 3/2007 | Angelle et al. | |
| 2002/0157823 | A1 | 10/2002 | Pietras et al. | |
| 2003/0221871 | A1 | 12/2003 | Hamilton | |
| 2005/0072274 | A1 | 4/2005 | Hauk et al. | |
| 2006/0053977 | A1 | 3/2006 | Hawkins, III | |
| 2006/0054331 | A1 | 3/2006 | Hawkins, III | |
| 2006/0179980 | A1 | 8/2006 | Pietras et al. | |
| 2006/0243490 | A1 | 11/2006 | Riel | |
| 2007/0017703 | A1 | 1/2007 | Belik | |
| 2010/0083796 | A1 * | 4/2010 | Nelson | 81/57.18 |

FOREIGN PATENT DOCUMENTS

| | | |
|---|---|---|
| DE | 29720465 | 1/1998 |
| DE | 20202396 | 6/2002 |
| EP | 1644608 B1 | 11/2007 |
| JP | 62-156468 | 10/1987 |
| JP | 07-062968 | 3/1995 |
| JP | 09/250285 | 9/1997 |
| JP | 2652808 | 9/1997 |
| JP | 02-194984 | 7/2002 |
| JP | 2003-184471 | 7/2003 |
| WO | WO98/26153 | 6/1998 |
| WO | WO99/06186 | 2/1999 |
| WO | WO99/55728 | 11/1999 |
| WO | WO03/033858 | 4/2004 |

OTHER PUBLICATIONS

Issue Notification dated Nov. 23, 2010 from U.S. Appl. No. 12/119,385, filed May 12, 2008 (1 page).
www.scorpion.com Scorpion Oil Tools 400 series.
U.S. Appl. No. 12/138,297, Mail Date Jan. 25, 2010 Restriction Requirement.
U.S. Appl. No. 12/197,817, Mail Date Jan. 13, 2010 Restriction Requirement.
U.S. Appl. No. 12/119,385, Mail Date Mar. 3, 2010 Office Action.
U.S. Appl. No. 12/138,297, Mail Date May 27, 2010 Office Action.
U.S. Appl. No. 12/197,817, filed May 20, 2010, Office Action.
PCT/US2008/067007, Dec. 23, 2008, International Search Report.
PCT/US2009/043628, Oct. 28, 2009, International Search Report.
PCT/US2008/074499, Mar. 11, 2010, International Search Report.
International Search Report dated Dec. 23, 2008 from PCT/US2008/067007 (4 pages).
Written Opinion dated Dec. 23, 2008 from PCT/US2008/067007 (6 pages).
Written Opinion dated Oct. 28, 2009 from PCT/US2009/043628 (5 pages).
International Search Report dated Jan. 21, 2009 from PCT/US2008/074499 (3 pages).
Written Opinion dated Jan. 21, 2009 from PCT/US2008/074499 (4 pages).
Notice of Allowance dated Sep. 24, 2010 from U.S. Appl. No. 12/119,385, filed May 12, 2008 (8 pages).
Office Action dated Nov. 9, 2010 from U.S. Appl. No. 12/138,297, filed Jun. 12, 2008 (11 pages).
Office Action dated Oct. 13, 2010 from U.S. Appl. No. 12/197,817, filed Aug. 25, 2008 (5 pages).
International Search Report and Written Opinion dated Dec. 1, 2009 as issued in International Application No. PCT/US2009/043633 filed May 12, 2009.
Office Action dated Jan. 27, 2011 from Australian Patent Application No. 2008265945 filed Jun. 13, 2008 (2 pages).
Notice of Allowance dated Jan. 28, 2011 from U.S. Appl. No. 12/138,297, filed Jun. 12, 2008 (15 pages).
Notice of Allowance dated Feb. 3, 2011 from U.S. Appl. No. 12/197,817, filed Aug. 25, 2008 (12 pages).
Notice of Allowance dated Apr. 15, 2011 from U.S. Appl. No. 12/138,297 filed Jun. 12, 2008 (8 pages).
Notice of Allowance dated Apr. 21, 2011 from U.S. Appl. No. 12/197,817 filed Aug. 25, 2008 (6 pages).
Supplemental Notice of Allowance dated May 3, 2011 from U.S. Appl. No. 12/197,817 filed Aug. 25, 2008 (4 pages).

* cited by examiner

OPEN-FACED ROD SPINNER

CROSS-REFERENCE TO RELATED APPLICATIONS

This application claims the benefit of and priority to U.S. Provisional Patent Application Ser. No. 61/052,577, filed May 12, 2008, entitled "OPEN-FACED ROD SPINNER," the entire contents of which are incorporated herein by reference.

BACKGROUND

1. Technical Field

The present disclosure relates generally to a tool for making or breaking a threaded connection between adjacent drilling components, such as drill rods.

2. Related Technology

Drilling rigs are often used for drilling holes into various substrates. Such drill rigs often include a drill head mounted to a generally vertically oriented mast. The rig can include mechanisms and devices that are capable of moving the drill head along at least a portion of the mast. The drill head may include mechanisms that receive and engage the upper end of a drilling rod or pipe. Conventional drilling processes include the utilization of specialized lengths of pipe with threaded ends, commonly referred to as drill rods. These drill rods are screwed together at the ends to form a continuous length of pipe, sometimes referred to as a rod string or drill string. The end of the rod string coupled to the drill head may be referred to as the head end or box end. The drill string may further include a cutting bit or other device on the end opposite the head end, referred to as the bit end or pin end of the drill string. The drill string may include multiple rods each having a length that is shorter than the usable length of the mast. Screwing two lengths of drill pipe together is commonly referred to as making the joint, while unscrewing two rods is commonly referred to as breaking the joint.

The drill head may apply a force to the drilling rod or pipe which in turn is transmitted to the drill string. If the applied force is a rotational force, the drill head may thereby cause the drill string to rotate within the bore hole. The rotation of the drill string may include the corresponding rotation of the cutting bit, which in turn may result in a cutting action. The forces applied by the drill head may also include an axial force, which may be transmitted along the drill string to facilitate penetration into the substrate.

In a conventional drill string, the head end of a drill rod is coupled to the drill head and the bit end of the drill rod is coupled to the head end of the next drill rod in the drill string and so on. During the drilling process, the drill head is typically advanced from an upper position on the mast until the drill head approaches the lower end of the mast. Once the drill head has reached the lower end, a clamp or other device is used to maintain the drill string in position relative to the mast. A breakout tool may then be used to break the joint between the drill string and the drill head. The drill head may then be disconnected from the drill string via counter-rotation of the drill head. The drill head is then raised to the upper end of the mast in preparation to receive another drilling pipe. A new length of drilling pipe is then positioned along the centerline of the mast and the drill head is rotatingly coupled to the new drilling pipe to a manufacturer-specified torque. The drill head may then be lowered such that the bit (male) end of the drill pipe may be engaged into the head (female) end of the drill string and the new drill pipe is rotated into the top of the exposed drill pipe in order to accurately make the joint. The new joint may be rotated until a manufacturer-specified torque is achieved. A breakout tool may also be used in the process of making the new joint. This process is continually repeated as the drilling of the borehole continues until the desired depth is reached. Following the achievement of the desired depth, or if the bit wears out and needs to be replaced, the lengths of drill pipe must be withdrawn from the bore hole.

In order to remove the lengths of drill pipe, a clamp is applied below the joint between the drill string and the drill head with the drill head being located at the lower end of the drill rig mast. Once again, a break out tool may be applied to break the joint between the drill head and the drill string. Once the drill head is disconnected from the drill string, a hoisting device may be used to raise the drill string until a full length of drill rod is exposed out of the bore hole. The drill string is then clamped below an exposed lower joint to be broken. The exposed lower joint may be broken and the drill rod removed via the hoisting device or other particular rod handling means on the drilling rig.

Many tools have traditionally been used for making and breaking threaded drill rod joints as discussed above. Conventional methods include the use of hand tools, such as wrenches, or modified hand tools attached to hydraulic cylinders. One additional conventional method includes the use of a rod spinner. A rod spinner is a device usually fixed to the mast of a drill rig and through the center of which passes the rod string. The rod spinner may include a motor and corresponding mechanism for gripping and rotating the outer surface of a drill rod in order to make and break joints. Accordingly, a rod spinner may grip and rotate the drill rod located above a joint, while a lower drill rod or drill string located below the joint is clamped to the mast using a foot clamp or other similar clamping device.

Conventional rod spinners often are unable to selectively engage a rod string when needed and retract when not in use. This results from the fact that the drill string typically passes through the center of conventional rod spinners thereby requiring that a drill string joint be broken prior to engaging or retracting the rod spinner. Conventional rod spinners normally stay in place while the rod string is being removed from or replaced back into the drill hole. As such, the rod string is pulled or fed through the center of the rod spinner until all the required lengths of rods were removed from the hole, which may inconvenience and hinder the drilling process and limit the use of rod spinners. Disadvantages also exist in relation to conventional mechanisms used in rod spinners for gripping and rotating drill rods to make and break joints.

The subject matter claimed herein is not limited to embodiments that solve any disadvantages or that operate only in environments such as those described above. Rather, this background is only provided to illustrate one example technology area where some embodiments described herein may be practiced.

BRIEF SUMMARY

The present disclosure relates to open-faced rod-spinning devices, systems, and methods configured for making and breaking connections between threaded drill rods. In particular, the open-faced rod-spinning devices may allow for the selective engagement and disengagement of a drill string when desired to make or break a drill rod joint. For example, the open face of the rod-spinning device allows it to be stored in a disengaged position and then selectively brought forward to engage a drill string when necessary to make or break a joint and then conveniently retracted away when not in use.

Because the rod-spinning device may not engage the drill string throughout the drilling process, the durability and maintenance of the rod-spinning device may be improved. In addition, the process of making and breaking joints, as well as the process adding drill rods to or removing drill rods from a drill string, may be quicker, easier, and more efficient.

In one example embodiment, an open-faced rod-spinning device may include a drive gear including an open face for receiving and rotating about a drill rod. In addition, the rod-spinning device may include a plurality of drive pins coupled to the drive gear. The rod-spinning device may also include an open-faced carriage assembly including a plurality of gripping lobes configured to be engaged by the drive pins.

In a further embodiment, an example drill mast may include a support structure. An open-faced rod-spinning device may be coupled to the support structure. The open-faced rod-spinning device may be configured for making and breaking connections between threaded drill rods. In particular, the open-faced rod-spinning device may include a casing having an open face for receiving a drill rod. The casing may also contain a gear system and a carriage assembly. For example, the gear system may include a drive gear having an open face for receiving and rotating about a drill rod. In addition, the gear system may further include a plurality of drive pins configured to engage and rotate the carriage assembly. In turn, the carriage assembly may include a plurality of gripping lobes configured to grip and rotate a drill rod when engaged by the drive pins. Finally, a clamping device may be coupled to the support structure and configured to selectively clamp a drill string.

In a yet further embodiment, an example drill rig in accordance with the present disclosure may include a base structure coupled to a mast. An open-faced rod-spinning device configured for making and breaking connections between threaded drill rods may be coupled to the base structure or mast. In particular, the open-faced rod-spinning device may include a gear system and a carriage assembly. In one embodiment, the gear system may include a drive gear having an open face for receiving and rotating about a drill rod and a plurality of drive pins coupled to the drive gear and configured to engage and rotate the carriage assembly. The carriage assembly may include an open face for receiving and rotating about a drill rod and may further include a plurality of gripping lobes configured to grip and rotate a drill rod when engaged by the drive pins.

These and other embodiments of the present disclosure will become more fully apparent from the following description and appended claims, or may be learned by the practice of the disclosure as set forth hereinafter.

BRIEF DESCRIPTION OF THE DRAWINGS

To further clarify the above and other embodiments of the present disclosure, a more particular description will be rendered by reference to specific embodiments thereof which are illustrated in the appended drawings. It is appreciated that these drawings depict only typical examples and are therefore not to be considered limiting of the disclosure's scope. Examples will be described and explained with additional specificity and detail through the use of the accompanying drawings in which.

DETAILED DESCRIPTION

The present disclosure includes systems, methods, and apparatuses configured for making and/or breaking joints between drill rods. In particular, the present disclosure includes an open-faced drill rod-spinning device as well as corresponding systems and methods. The open-faced rod-spinning devices may allow for the selective engagement and disengagement of a drill string when desired to make or break a drill string joint. For example, the open face of the rod-spinning device allows it to be stored in a disengaged position and then selectively brought forward to engage the drill string when necessary and then retracted when not needed. In addition, the process of making and breaking joints, as well as the process adding drill rods to or removing drill rods from a drill string, may be quicker, easier, safer, and more efficient.

Figure 1:
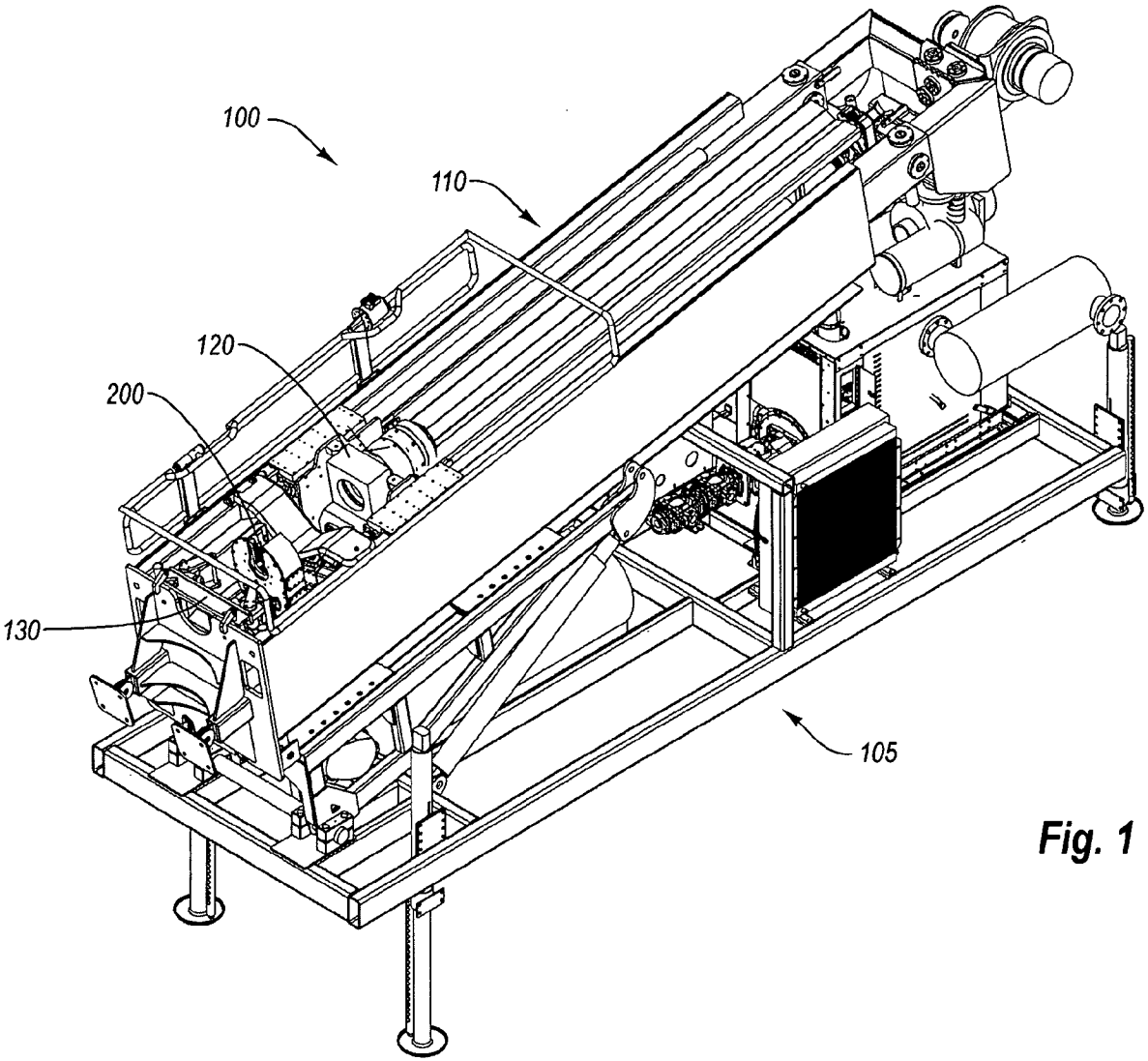
FIG. 1 discloses a perspective view of an example drill rig including a drill mast and an open-faced rod-spinning device in accordance with an implementation of the present disclosure.

Reference is now made to the Figures which illustrate various example embodiments of the present disclosure. For example, FIG. 1 illustrates a perspective view of an example drill rig 100 in accordance with an implementation of the present disclosure. In particular, the drill rig 100 may include a base structure 105 which supports a drill mast 110. In one embodiment, the base structure 105 may be mobilized in order to facilitate transportation of the drill rig 100. For example, the base structure 105 may be coupled to a plurality of axles and wheels or a plurality of tracks in order to facilitate mobilization of the drill rig 100.

As illustrated, the drill mast 110 is in a substantially horizontal position. However, once the drill rig 100 is positioned to begin the drilling process, the drill rig 1100 may raise the drill mast 110 to any desired angle for the bore hole to be drilled. In one example embodiment, the angles at which the drill mast 110 may be positioned may include a range from about directly vertical or 0° to about a 45° angle. A rod-spinning device 200 may be coupled directly to the drill mast 110, may be coupled directly to the base structure 105 of the drill rig 100, or may be coupled to a rod-handling device associated with the drill rig 100 or drill mast 110. In a further embodiment, the rod-spinning device 200 may be used during the drilling process to selectively engage and disengage a drill string in order to make and/or break drill rod joints.

Figure 2:
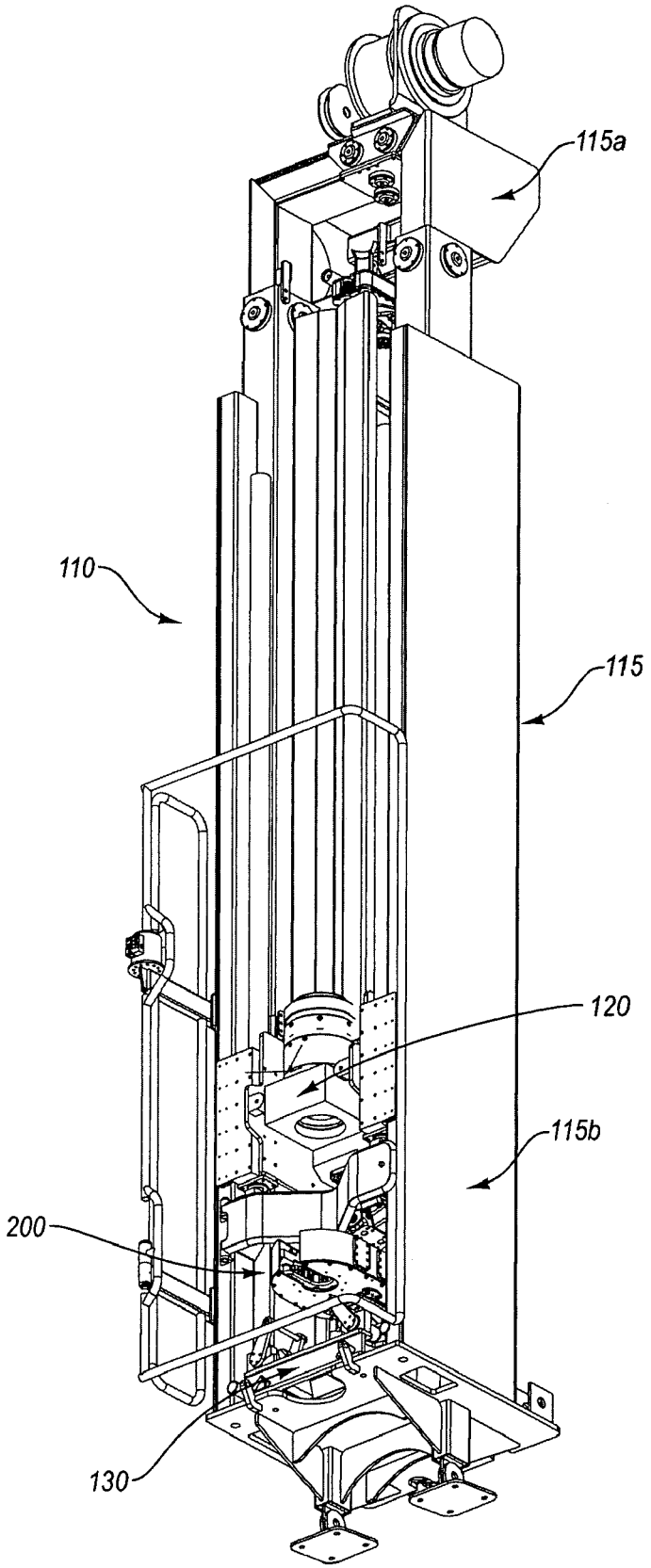
FIG. 2 discloses a perspective view of the example drill mast of FIG. 1, including an open-faced rod-spinning device in accordance with an implementation of the present disclosure.

Reference is now made to FIG. 2, which illustrates an elevation view of the example drill mast 110 of FIG. 1, including a rod-spinning device 200 associated therewith in accordance with an implementation of the present disclosure. In the illustrated example, the drill mast 110 includes a support structure 115 which may support various components associated with the drill mast 110, including a drill head 120, the rod-spinning device 200, and a clamping device 130. In particular, the support structure 115 may include various framing elements configured to give support to and/or guide drilling components during the drilling process.

In one embodiment, the support structure 115 of the drill mast 110 may be configured to extend and retract between a first length and a second length greater than the first length. For example, the support structure 115 may be configured to move to a lower first length to facilitate transportation of the drill mast 110 and then move to a second length when in position to drill in order to extend the usable length of the drill mast 110, thereby increasing the capability of handling longer drill rods during the drilling process. In one embodiment, the second length may be equal to or greater than twice the first length.

As mentioned, in one embodiment, the support structure 115 may be coupled with and support a drill head 120. In particular, the support structure 115 may support the drill head 120 as the drill head 120 translates between an upper end 115*a* and a lower end 115*b* of the support structure 115. FIG. 2 illustrates the drill mast 110 with the drill head 120 located nearer the lower end 115*b* of the support structure 115.

In a further embodiment, the drill head 120 may be operatively associated with a drill string including any number of drill rods. The drill head 120 may include mating features configured to engage corresponding mating features in the head or upper end of a drill rod. In at least one example embodiment, the drill head 120 may include male features, such as external threads while a head or box end of the drill rod may include female features, such as internal threads configured to couple with the external threads of the drill head 120. Accordingly, in at least one example, a box end of a drill rod may be rotated into engagement with the drill head 120. A bit or pin end of the drill rod may include male features, such as external threads, such that multiple drill rods may be coupled together to form a drill string.

A drill bit may be operatively associated with a lower or pin end of the drill string. In one example embodiment, the drill head 120 applies forces to the drill string, which are at least partially transmitted to the drill bit to cause the drill bit and drill string to advance through a substrate. The forces applied to the drill string may include, without limitation, rotary, axial, percussive, and/or vibratory forces as well as any combination of forces. For ease of reference, the following examples will be discussed in the context of a drill head that is configured to apply rotary and axial forces to the drill string and thence the drill bit. For case of reference, the rotary forces may be described herein as rotation in a clock-wise or first direction.

In one embodiment, the drill mast 110 and/or drill head 120 may also include machinery and/or devices for translating the drill head 120 relative to the support structure 115 from the upper end 115*a* to a lower end 115*b* of the support structure 115 and vice versa. For example, in one embodiment, the drill mast 110 or drill head 120 may include a chain drive, belt drive, or screw drive for translating the drill head 120 along the support structure 115. As a result, the drill head 120 may advance as the drill bit and drill string penetrate the substrate.

As introduced above, FIG. 2 further illustrates the rod-spinning device 200 coupled to the drill mast 110 above the clamping device 130, and below the drill head 120. In particular, the rod-spinning device 200 may include an open face configured to selectively engage a drill rod or drill string. In one embodiment, the open face may face away from the drill mast 110. However, the rod-spinning device 200 may be located at any of a number of positions with its open face facing toward or away from the drill mast 110. For example, the rod-spinning device 200 may be rotatably coupled to the side of the drill mast 100 and configured to rotate into an engaged position. In a further embodiment, the rod-spinning device 200 may be independent of the drill mast 110 and may be moved into engagement when desired and moved out of engagement when not being used.

As discussed above, the drill mast 110 may include a clamping device 130, such as a foot clamp, operatively associated with the support structure 115. During normal drilling operations, both the clamping device 130 and the rod-spinning device 200 may be disengaged from the drill string. During a drilling operation where the drill head 120 has reached the lower end 115*b* of the support structure 115, the drill string may be clampingly retained to the lower end 115*b* of the support structure 115 by the clamping device 130 and the drill head 120 may be reversed to break the joint between the drill head 120 and the clamped drill string. For example, the clamping device 130 may apply sufficient force to minimize rotation of the drill string as the drill head 120 is rotated in a counter-clockwise or second direction, the second direction being opposite the first direction.

The drill head 120 may be raised to the upper end 115*a* of the support structure 115 and a new length of drill pipe may be loaded into the drill mast 110. The drill head 120 may then be lowered into proximity with the box end of the new length of drill pipe and rotated to engage the drill pipe. The drill head 120 may then lower slowly until the pin end of the new length of drill pipe engages the box end of the drill string being clamped by the clamping device 130. During this process, the rod-spinning device 200 may be brought forward to engage and rotate the new length of drill pipe in order to make the joints between the new length of drill pipe and the drill string and/or between the new length of drill pipe and the drill head 120. In a further embodiment, the rod-spinning device 200 may apply a specified torque to the new length of drill pipe to achieve a specified torque in the joints with the drill head and/or drill string.

In one implementation, the rod-spinning device 200 may be horizontally extended on a plane perpendicular to the support structure 115 to engage the new length of drill pipe in a position which is just above the joint to be made between the new drill pipe and the drill string. After the joint is made, the rod-spinning device 200 may be retracted to a disengaged position.

In a further embodiment, the rod-spinning device 200 may be rotated from a vertical, disengaged position to a horizontal, engaged position. Once a joint is made or broken as desired, the rod-spinning device 200 may then rotate from the horizontal, engaged position to a vertical, disengaged position. In a yet further embodiment, the rod-spinning device 200 may be independent of the drill mast 110 and may be configured to be rolled, moved, and/or rotated into place to engage a drill rod and rolled or moved away to disengage the drill rod.

Figure 3:
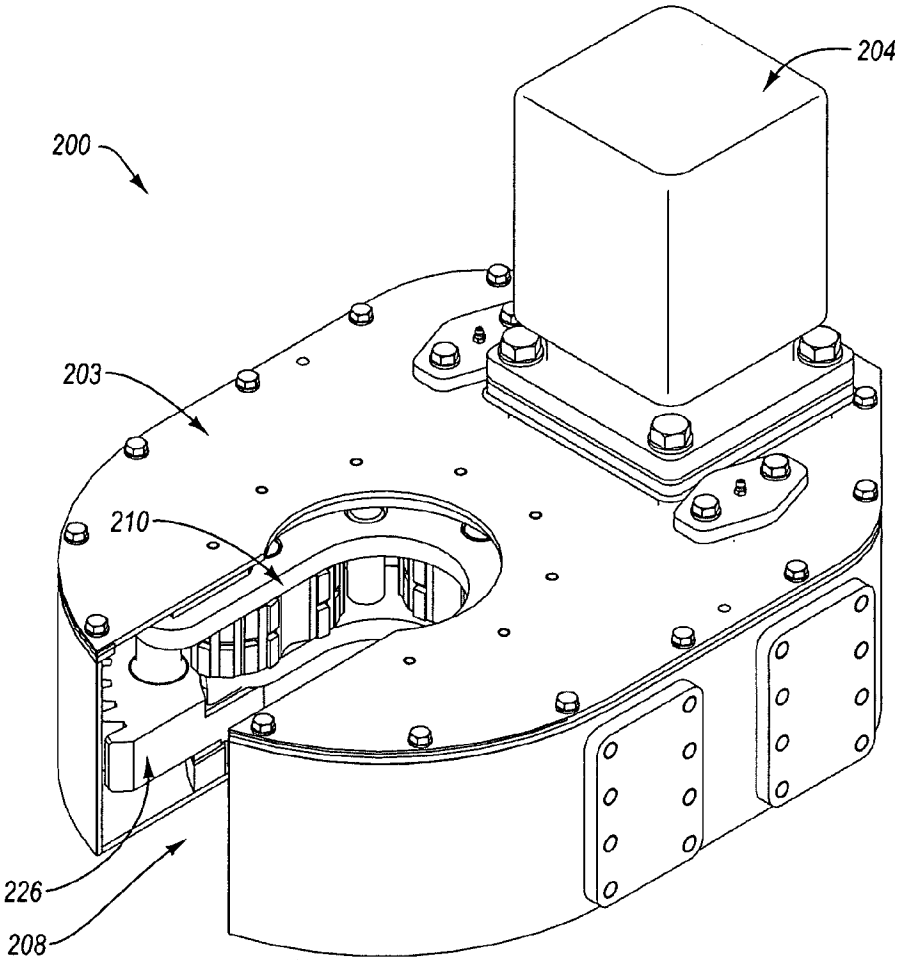
FIG. 3 discloses a perspective view of an example open-faced rod-spinning device in accordance with an implementation of the present disclosure.

Reference is now made to FIG. 3 which illustrates an example rod-spinning device 200 in accordance with an implementation of the present disclosure. The example rod-spinning device 200 may include a casing 202 and casing cover 203 configured to house the internal components of the example rod-spinning device 200. In the illustrated example embodiment, the casing 202 may include an open face 208 (or channel) configured to receive/engage an elongated member such as a drill rod. In a further embodiment, the casing cover 203 may include a single plate-like piece, or, in a further embodiment, may include a plurality of pieces forming the casing cover 203. For example, the casing cover 203 may be split down the middle to facilitate maintenance of the internal components of the rod-spinning device 200 without having to remove the entire casing cover 203 or remove other components, such as the motor 204.

FIG. 3 also illustrates a motor 204 coupled to the casing 202 which may be configured for driving the internal components of the rod-spinning device 200. In one example embodiment, the motor 204 may be a hydraulic motor. In further embodiments, the motor 204 may be an electric motor, a combustion motor, or other similar motors. Although the example motor 204 of FIG. 3 is shown mounted on the top of the rod-spinning device 200, in further embodiments, the motor 204 may be mounted at any location of the rod-spinning device 200 as desired.

As further illustrated in FIG. 3, the casing 202 of the rod-spinning device 200 may house various internal components, including a carriage assembly 210 and a drive gear 226. In particular, the carriage assembly 210 and drive gear 226 may also each include an open face configured for receiving a drill rod. In at least one embodiment, the motor 204 may be actuated until the open face of the carriage assembly 210 aligns with the open face 208 of the casing 202. At this point, because the open face of the drive gear 226 may not be aligned with the open face of the carriage assembly 210 during rotation, it may be necessary to reverse the motor 204 slightly such that the open face of the drive gear 226 also aligns with the open face 208 of the casing 202. This position, as illustrated in FIG. 3, may be referred to herein as the parked position.

Once the rod-spinning device 200 is in the parked position, the rod-spinning device 200 may be brought forward to a working position, wherein the rod-spinning device 200 receives and engages a drill rod. Once in the working position, the motor 204 may selectively operate the drive gear 226 and carriage assembly 210 to engage and rotate the drill rod in a clockwise or counter-clockwise direction.

Figure 4:
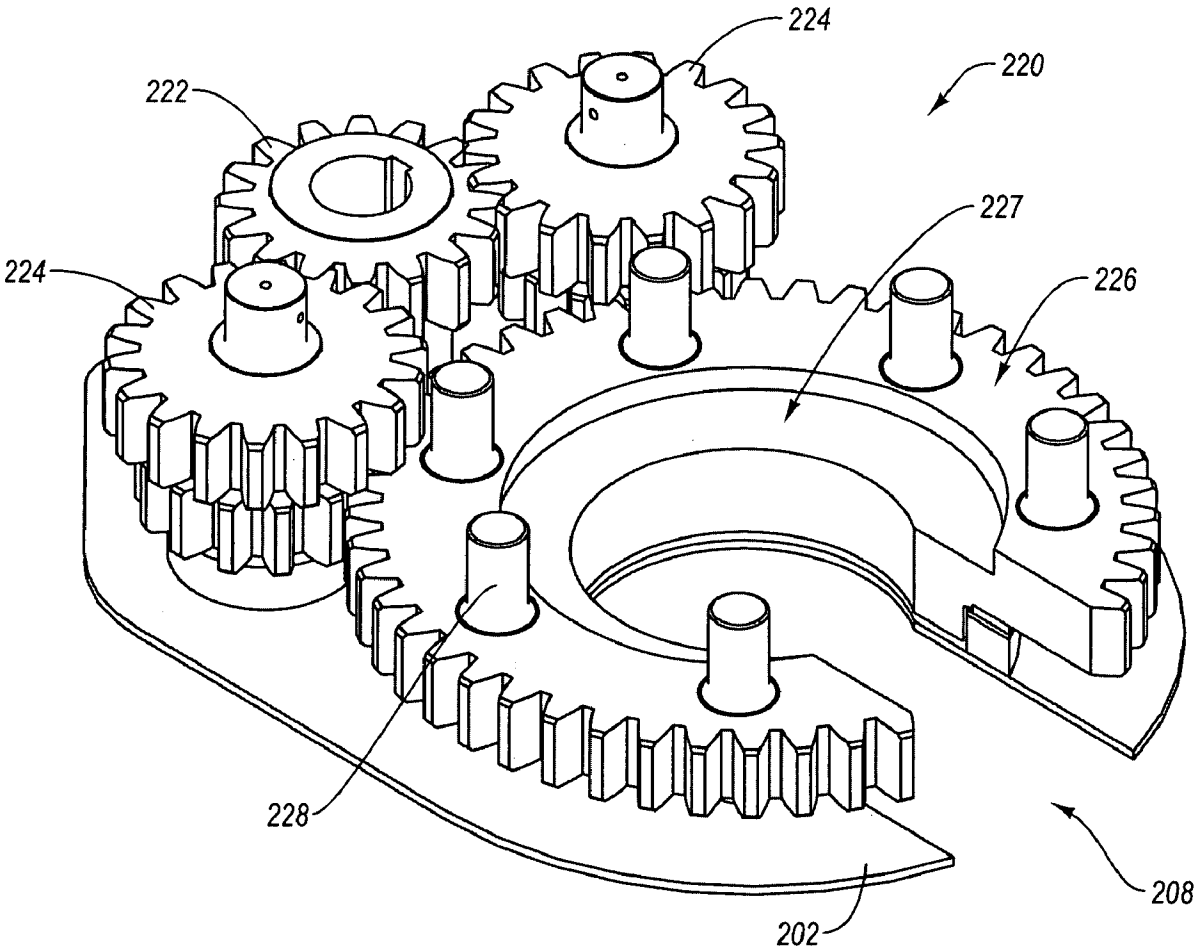
FIG. 4 discloses a perspective view of various internal components of the example open-faced rod-spinning device of FIG. 3 in accordance with an implementation of the present disclosure.

With continuing reference to FIG. 3, reference is now made to FIG. 4, which illustrates an example gear system 220 in accordance with at least one embodiment of the present disclosure. In one embodiment, the example gear system 220 may include a pinion gear 222, two idler gears 224, a drive gear 226, and a plurality of drive pins 228 coupled to the drive gear 226. As illustrated, the drive gear 226 may include an open face and a hollow center such that the drive gear 226 may releasably engage and rotate about a drill rod.

In one example embodiment, the motor (i.e., 204, FIG. 3) may be configured to drive the drive gear 226 according to a drive chain in which the motor 204 rotates the pinion gear 222, which then engages and rotates the pair of idler gears 224, which in turn engage and rotate the drive gear 226. The use of multiple idler gears 224 may facilitate rotation of the drive gear 226 despite the open face of the drive gear 226. For example, the multiple idler gears 224 may be positioned such that at least one idler gear 224 engages the teeth of the drive gear 226 at all times as the drive gear 226 rotates despite the gap in the drive gear 226 created by the drive gear's open face.

Figure 5:
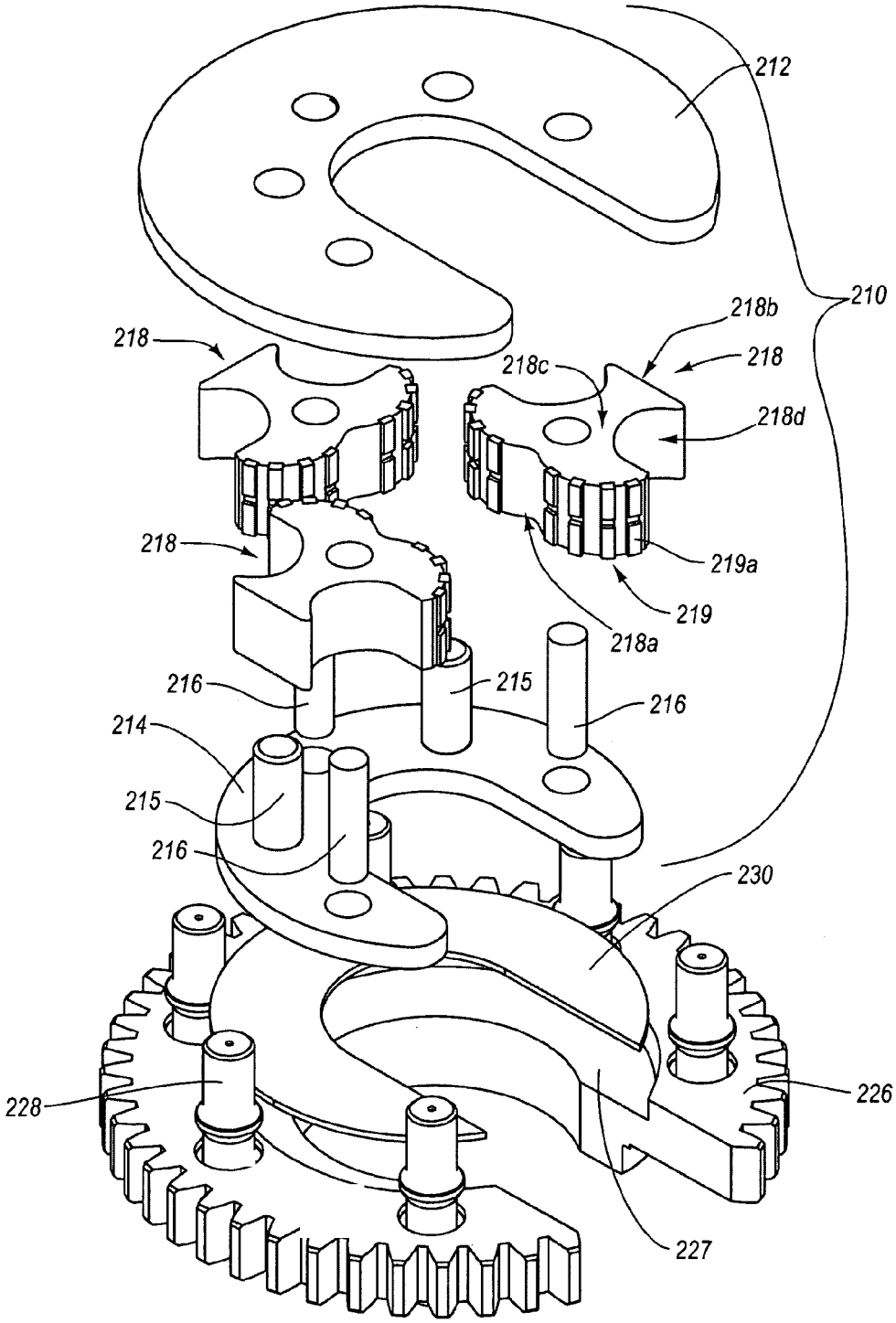
FIG. 5 discloses an exploded view of a carriage assembly and drive gear of the example open-faced rod-spinning device of FIG. 3 in accordance with an implementation of the present disclosure.

The drive gear 226 may include or be coupled to drive pins 228 configured to engage and rotate the carriage assembly (i.e., 210, FIG. 5). The drive gear 226 may also include a recess 227 in which the carriage assembly (i.e., 210, FIG. 3) may be at least partially positioned.

Torque generated by the rod-spinning device 200 may be a function of the torque output of the motor 204 and the gear reduction between the pinion gear 222 and the drive gear 226. In one implementation, the amount of torque applied by the rod-spinning device 200 to a drill rod may be controlled by adjusting the torque output of the motor 204. Accordingly, a specified desired torque may be achieved in making drill rod joints.

Reference is now made to FIG. 5 which illustrates an exploded view of a carriage assembly 210 and drive gear 226 of an example rod-spinning device 200 of FIG. 1 in accordance with an implementation of the present disclosure. As illustrated, the carriage assembly 210 may include a top plate 212 and a bottom plate 214 that define a space therebetween. The top plate 212 and bottom plate 214 may be coupled together by a plurality of pins 216, 215, including pivot pins 216 and/or spacer pins 215. The pivot pins 216 may be configured to act as axles for a plurality of gripping lobes 218. Accordingly, each pivot pin 216 may couple at one end to the top plate 212, pass through a corresponding gripping lobe 218, and then couple at the opposite end to the bottom plate 214. In addition, the spacer pins 215 may ensure proper spacing of the top plate 212 and bottom plate 214 to allow the gripping lobes 218 to rotate freely about the pivot pins 216.

In one embodiment, the drive gear 226 may include a recess 227 or cavity configured for receiving the bottom plate 214 of the carriage assembly 210. The carriage assembly 210 may also be configured to rotate within the recess 227 and relative to the drive gear 226. Accordingly, as the drive gear 226 rotates relative to the carriage assembly 210, the drive pins 228 may engage the gripping lobes 218 and rotate the gripping lobes 218 about the pivot pins 216. Rotation of the gripping lobes 218 may move the gripping surface 219 and/or gripping elements 219*a* inward toward a drill rod. Once the gripping lobes 218 have engaged the outside diameter of the drill rod, the drive gear 226, carriage assembly 210, and engaged drill rod may rotate together.

A carriage assembly bearing 230 may also be included and placed in the recess 227 between the drive gear 226 and the bottom plate 214 of the carriage assembly 210. In one implementation, the carriage assembly bearing 230 may be configured to facilitate the rotation of the carriage assembly 210. The carriage assembly bearing 230 may be manufactured using any material that will allow the bottom plate 214 of the carriage assembly 210 to rotate within the recess 227 relative to the drive gear 226. In one implementation, the carriage assembly bearing 230 is manufactured using a polymer, such as polyethylene. In a further embodiment, the rod-spinning device 200 may include a friction element (i.e., 232, FIG. 6) configured to apply a sufficient frictional force to the carriage assembly 210 to facilitate relative movement between the drive gear 226 and carriage assembly 210 as the drive gear 226 rotates, as discussed in more detail below.

As shown in FIG. 5, the gripping lobes 218 may include a head end 218*a*, a flared tail end 218*b*, and a narrow waist 218*c*. In particular, the head end 218*a* may define a gripping surface 219 configured to engage the outside surface of a drill rod. The head end 218*a* may further include gripping elements 219*a* along the gripping surface 219, wherein the gripping elements 219*a* are configured for providing grip to the outside diameter of a drill rod. In one implementation, the gripping elements 219*a* may include tungsten carbide inserts. In a further implementation, the gripping elements 219*a* may include any teeth or pyramidal points configured to grip the outside surface of a drill rod. In a further embodiment, the head end 218*a* of the gripping lobes 218 may be eccentrically shaped such that rotating the gripping lobes 218 about the pivot pins 216 produces a cam effect wherein the gripping surface 219 of the gripping lobe 218 extends forward to engage a drill rod.

The waist 218*c* and flared tail end 218*b* may be configured to be engaged by the drive pins 228 to rotate the gripping lobes 218 about the pivot pins 216. In particular, the waist 218*c* and flared tail end 218*b* may define one or more indentations 218*d* along the sides of the gripping lobe 218 configured for receiving a drive pin 228. Accordingly, a drive pin 228 may engage the gripping lobe 218 to rotate the gripping lobe 218 about the pivot pin 216 into engagement with a drill rod. In turn, the entire carriage assembly 210 rotates once the gripping lobes 218 engage the outside surface of a drill rod, thereby resisting any further rotation by the gripping lobes 218 about the pivot pins 216.

In one embodiment, the indentations 218*d* may be located on each side of the gripping lobe 218 in order to receive drive pins 228 from either side. As a result, drive pins 228 may engage and rotate the gripping lobe 218 in either a clockwise or counter-clockwise direction. In one implementation, the indentations 218*d* may be either curved and/or angular shape.

As is further illustrated, each of the gripping lobes 218 may be symmetrically shaped about a centered, vertical plane extending through the centers of each of the tail end 218*b* and head end 218*a*. This symmetric configuration may allow the gripping lobes 218 to operate similarly whether engaged by a drive pin 228 rotating in a clockwise or counter-clockwise direction. Accordingly, the gripping lobes 218 may engage and rotate a drill rod in different rotational directions to selectively make and/or break drill rod joints.

FIG. 5 further illustrates a plurality of drive pins 228 coupled to the drive gear 226. In one implementation, the drive gear 226 is configured to include two drive pins 228 for every gripping lobe 218 of the carriage assembly 210 such that one drive pin 228 may be located on each side of the gripping lobes 218. The drive pins 228 may be further configured to engage and rotate the gripping lobes 218. It will be appreciated, however, that the rod-spinning device may include more or less drive pins 228 and more or less gripping lobes 218 than shown in FIG. 5.

Figure 6:
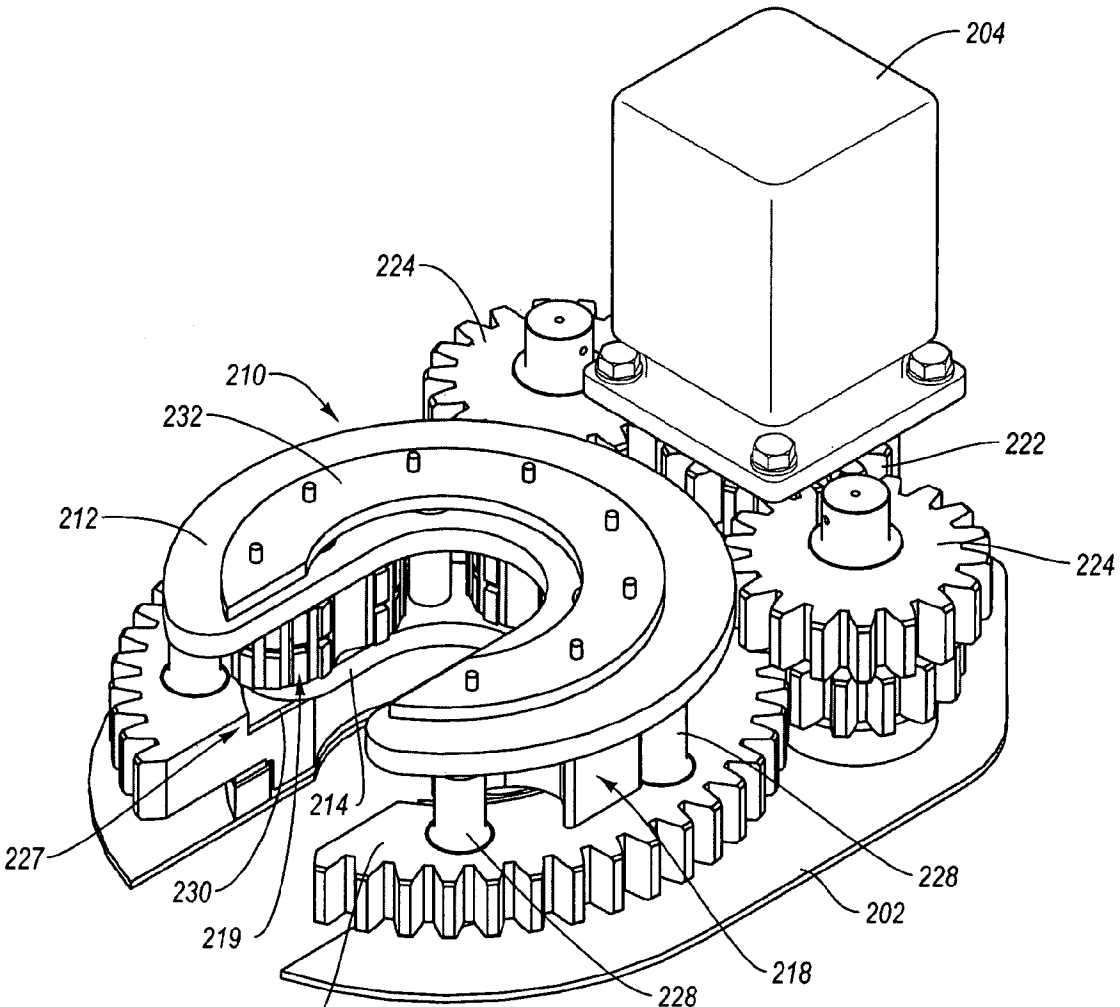
FIG. 6 discloses a perspective view of various internal components of the example open-faced rod-spinning device of FIG. 3 in accordance with an implementation of the present disclosure.

Reference is now made to FIG. 6 which illustrates a perspective view of the internal components of the rod-spinning device 200 of FIGS. 1-5 wherein the carriage assembly 210 is assembled into the rod-spinning device 200 atop the drive gear 226. As FIG. 6 illustrates, in one embodiment, the carriage assembly 210 may be positioned on top of the drive gear 226 such that the bottom plate 214 of the carriage assembly 210 is positioned at least partially within the recess 227 of the drive gear 226. In a further embodiment, the drive pins 228 may be configured to be located on opposite sides of the gripping lobes 218.

FIG. 6 further illustrates a friction element 232 located on top of the carriage assembly 210. The friction element 232 may be coupled to the underside of a casing cover (i.e., 203, FIG. 3) and configured to apply a frictional force to the top plate 212 of the carriage assembly 210. Accordingly, when the motor 204 is actuated and the drive gear 226 rotates via the drive chain described above, the friction element 232 may apply a sufficient frictional force to the top plate 212 of the carriage assembly 210 to maintain the carriage assembly 210 stationary as the drive gear 226 rotates. Specifically, the friction element 232 applies a frictional force greater than the frictional force between the bottom plate 214 and the bearing 230 or between the bearing 230 and the drive gear 226. As a result, the drive gear 226 continues to rotate relative to the carriage assembly 210 until the drive pins 228 come into contact with and engage the gripping lobes 218, causing the gripping lobes 218 to rotate about the pivot pins (i.e., 216, FIG. 5). In turn, the gripping lobes 218 may rotate about the pivot pins (i.e., 216, FIG. 5) until the gripping surface 219 and/or gripping elements (i.e., 219*a*, FIG. 5) come into contact with the outside diameter of a drill rod. Once the gripping lobes 218 have engaged the outside diameter of the drill rod, sufficient torque may be generated by the motor 204 to overcome the frictional force created by the friction element 232 such that the carriage assembly 210 and drive gear 226 rotate as a complete unit to rotate the drill rod. In a further embodiment, the frictional force of the friction element 232 may be selectively applied and released as desired. For example, an operator may selectively activate the friction element 232 to apply a frictional force to the carriage assembly 210 and then deactivate the friction element 232 to release the frictional force from carriage assembly 210.

Figure 7:
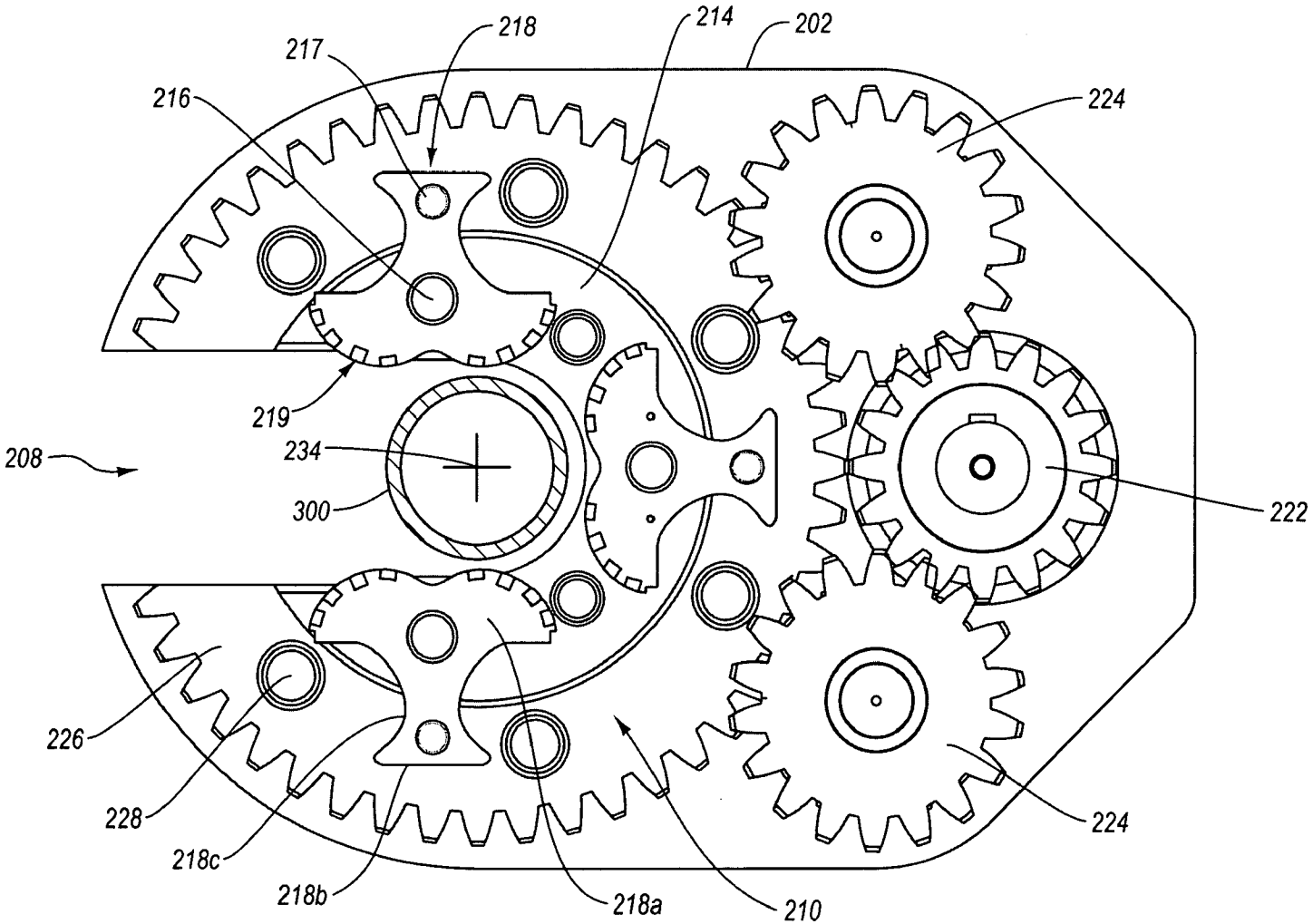
FIG. 7 discloses a schematic top view of various internal components of the example open-faced rod-spinning device of FIG. 3 in accordance with an implementation of the present disclosure.

Reference is now made to FIG. 7 which illustrates a schematic top view of some components of the example rod-spinning device 200 of FIG. 1 engaging a drill rod 300. In particular, FIG. 7 illustrates the drive gear 226, drive pins 228, gripping lobes 218, bottom plate 214, gripping elements 219, pinion gear 222, and idler gears 224. FIG. 7 further illustrates the centerline 234 of the drill rod 300 engaged by the rod-spinning device 200. As discussed above, actuation of the motor (i.e., 204, FIG. 3) rotates the drive gear 226 via the idler gears 224 and pinion gear 222. Due to the frictional force of the friction element 232, the carriage assembly 210 may remain stationary as the drive gear 226 rotates until the drive pins 228 engage the gripping lobes 218. As a result, the gripping lobes 218 may rotate about the pivot pins 216 while the carriage assembly 210 remains otherwise stationary, causing the gripping surfaces 219 of the gripping lobes 218 to move towards the centerline 234 and engage the drill rod 300. Once the gripping lobes 218 engage and grip the outer surface of the drill rod 300, the friction from the friction element 232 may be overcome and the drive gear 226, carriage assembly 210, and drill rod 300 rotate together to make or break a joint in a drill string. In one implementation, the torque applied to the drill rod 300 may be controlled and configured to achieve a desired torque, such as a manufacturer-specified torque. In one embodiment, the manufacturer-specified torque may vary depending on the size of the drill rod 300. The rod-spinning device 200 may be configured to operate with various drill rod sizes. In one example embodiment, the rod-spinning device 200 may be configured, including configuring the size of the gripping lobes 218 and the open face 208, to engage drill rods as small B-sized rods and as large as P-sized rods.

As is further illustrated by FIG. 7, in order to maintain the proper position of the gripping lobes 218 when disengaged by the driving pins 228, the gripping lobes 218 may include a mechanism for maintaining a desired alignment of the gripping lobes 218. For example, in one implementation, a first magnet 217 may be placed near an upper surface of the gripping lobe 218 proximate the tail end 218*b* or waist 218*c*. A second magnet (not shown) may be placed near a bottom surface of the top plate (i.e., 212, FIG. 5) of the carriage assembly 210 and configured to attract the first magnet 217 to produce a desired alignment of the gripping lobe 218 when not engaged by the driving pins 228. In a further embodiment, one or more additional magnets with the same polarity as the first magnet 217, may be configured to repel the first magnet 217 away from undesirable alignments and towards a desired alignment.

Figure 8:
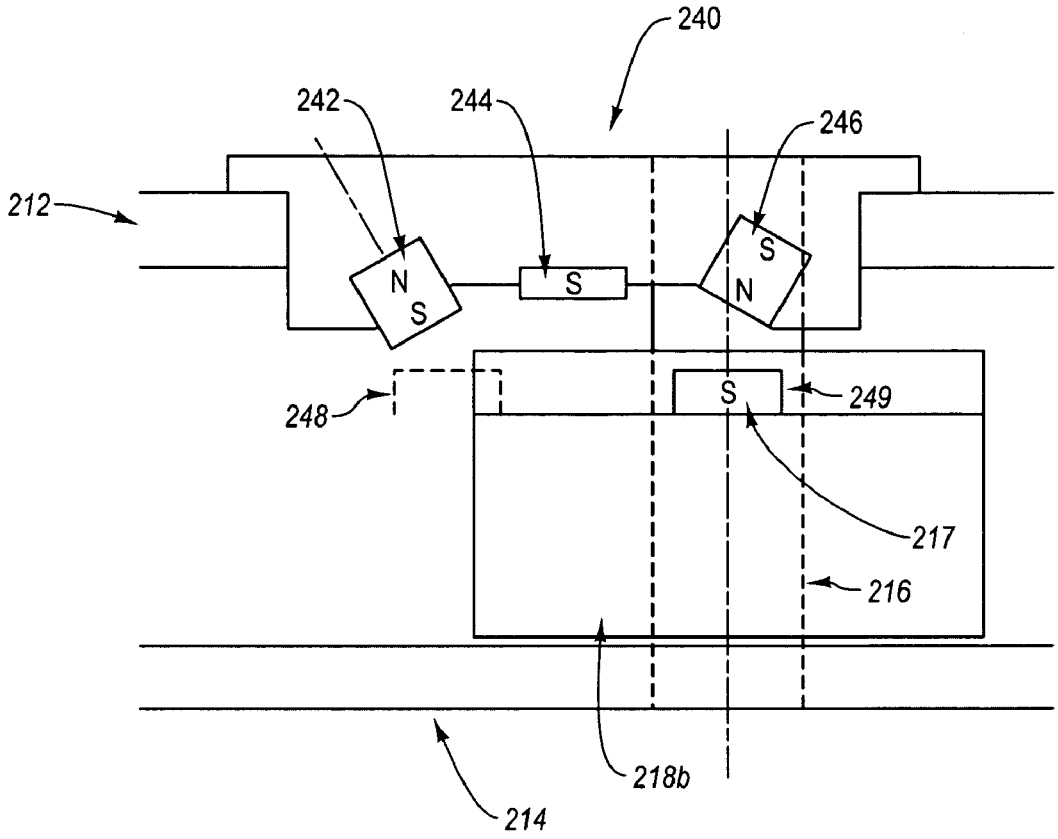
FIG. 8 discloses a schematic view of an example system of magnets and a mounting plate.

For example, as illustrated in FIG. 8 which illustrates a partial schematic view of the carriage assembly 210 including an end view of a tail end 218*b* of a gripping lobe 218, a mounting plate 240 may be coupled to the top plate 214 of the carriage assembly 210. As is shown in FIG. 8, a plurality of magnets 242, 244, 246 may be coupled to the mounting plate 240 and configured to align the gripping lobe 218. In one example embodiment, the mounting plate 240 may include a second magnet 242 and a third magnet 244 configured with the same polarity as the first magnet 217 coupled to the gripping lobe 218. As a result, the second magnet 242 and third magnet 244 may repel the first magnet 217 from an unaligned position 248 towards a properly aligned position 249. By repelling the first magnet 217 to the aligned position 249, the gripping lobe 218 may also move, such as by rotating, into a desired alignment. Furthermore, the mounting plate 240 may include a fourth magnet 246 with opposite polarity as the first magnet 217 coupled to the gripping lobe 218 and configured to attract the first magnet 217 to the aligned position 249, thereby aligning the gripping lobe 218.

As a result and referring again to FIG. 7, when the rod-spinning device 200 is activated and the driving pins 228 engage the gripping lobes 218, the force of the driving pins 228 may overcome the magnetic forces created by the magnets 217, 242, 244, 246 and displaces the gripping lobes 218 from their magnetized alignment. When the driving pins 228 disengage the gripping lobes 218, the magnetic force may return the gripping lobes 218 to their magnetized alignment as shown in FIG. 7 so as not to obstruct the engagement and/or release of drill rods by the rod-spinning device 200. In a further embodiment, one or more springs (not shown) may be used in the alternative or in addition to the magnets. In particular, each spring may be coupled at one end to a portion of the gripping lobe 218 and coupled at the other end to another portion of the carriage assembly. For example, the springs may be configured to return the gripping lobe 218 to a desired alignment when disengaged by the driving pins 228. Accordingly, when the rod-spinning device 200 is in the parked position (shown in FIG. 7), the gripping lobes 218 may be aligned so as to easily receive or release the drill rod 300.

Figure 9:
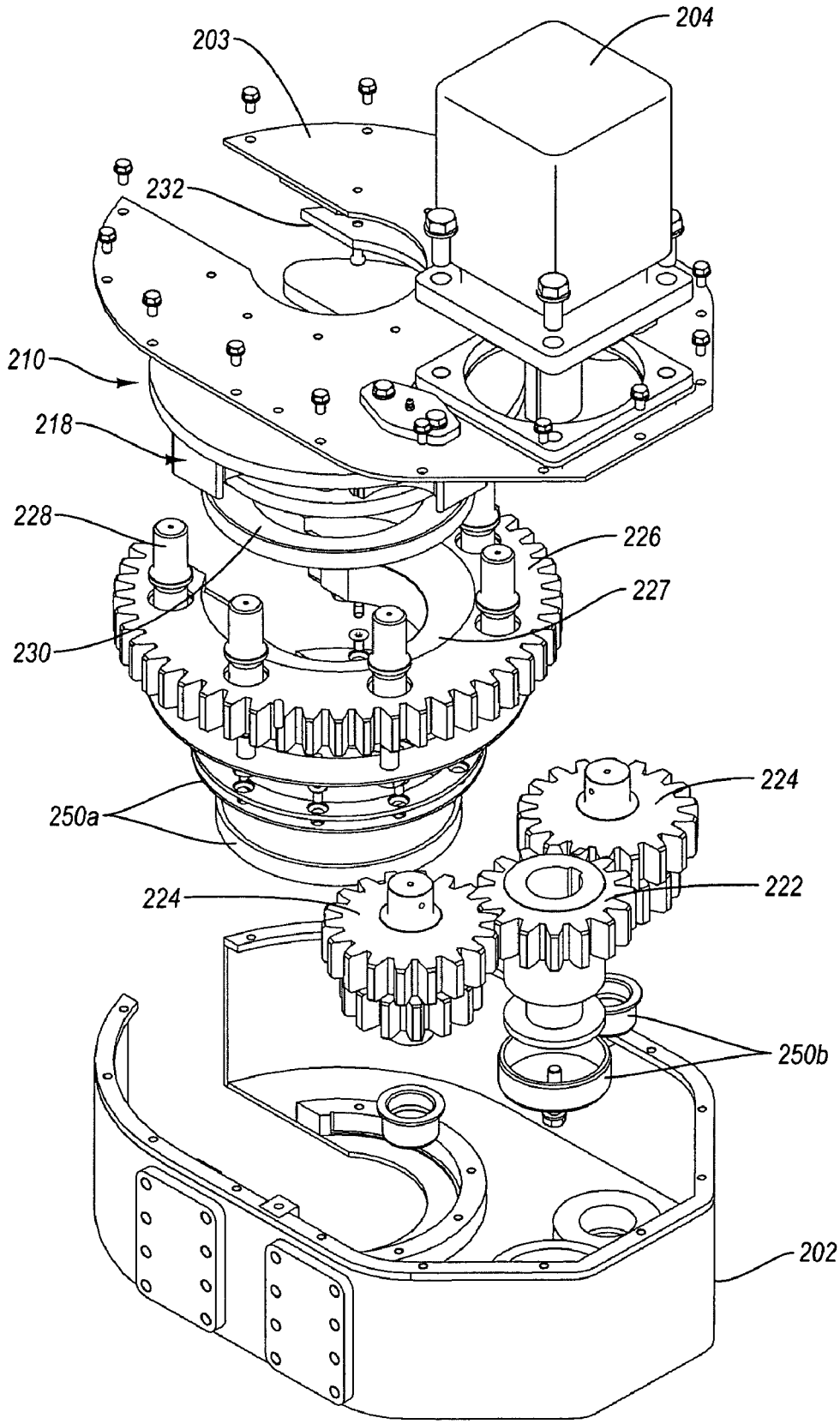
FIG. 9 discloses an exploded view of elements of the example open-faced rod-spinning device of FIG. 3 in accordance with an implementation of the present disclosure.

Reference is now made to FIG. 9 which illustrates an exploded view of an example rod-spinning device 200 of the present disclosure. As illustrated, the rod-spinning device 200 may include a casing 202 configured to house and allow rotation of a pinion gear 222, idler gears 224, and drive gear 226. FIG. 9 further illustrates the use of gear bearings 250*a*, 250*b* in conjunction with the pinion gear 222, idler gears 224, and drive gear 226 in order to facilitate rotational movement of the gears 222, 224, 226. In one embodiment, drive pins 228 may be coupled to the drive gear 226 and configured to interface with gripping lobes 218 of a carriage assembly 210. FIG. 9 further illustrates the use of a carriage assembly bearing 230 at the point where the carriage assembly 210 interfaces with the drive gear 226 to facilitate independent rotational movement of the drive gear 226 relative to the carriage assembly 210. In addition, a friction element 232 may be coupled to the casing cover 203. The friction element 232 may be configured to apply a frictional force to the carriage assembly 210 to restrict rotational movement of the carriage assembly 210 with respect to the drive gear 226 as discussed in more detail above. As FIG. 9 illustrates, the casing cover 203 may be fastened to the casing 202 to contain the internal components of the rod-spinning device 200. The illustrated rod-spinning device further includes a motor 204 in mechanical communication with the pinion gear 222 and coupled to the casing 202 such that actuation of the motor 204 rotates the pinion gear 222, which in turn rotates the idler gears 224 and drive gear 226. In one embodiment, rotation of the gears 224, 226 and pinion gear 222 may be facilitated by the gear bearings 250*a*, 250*b*.

Figure 10:
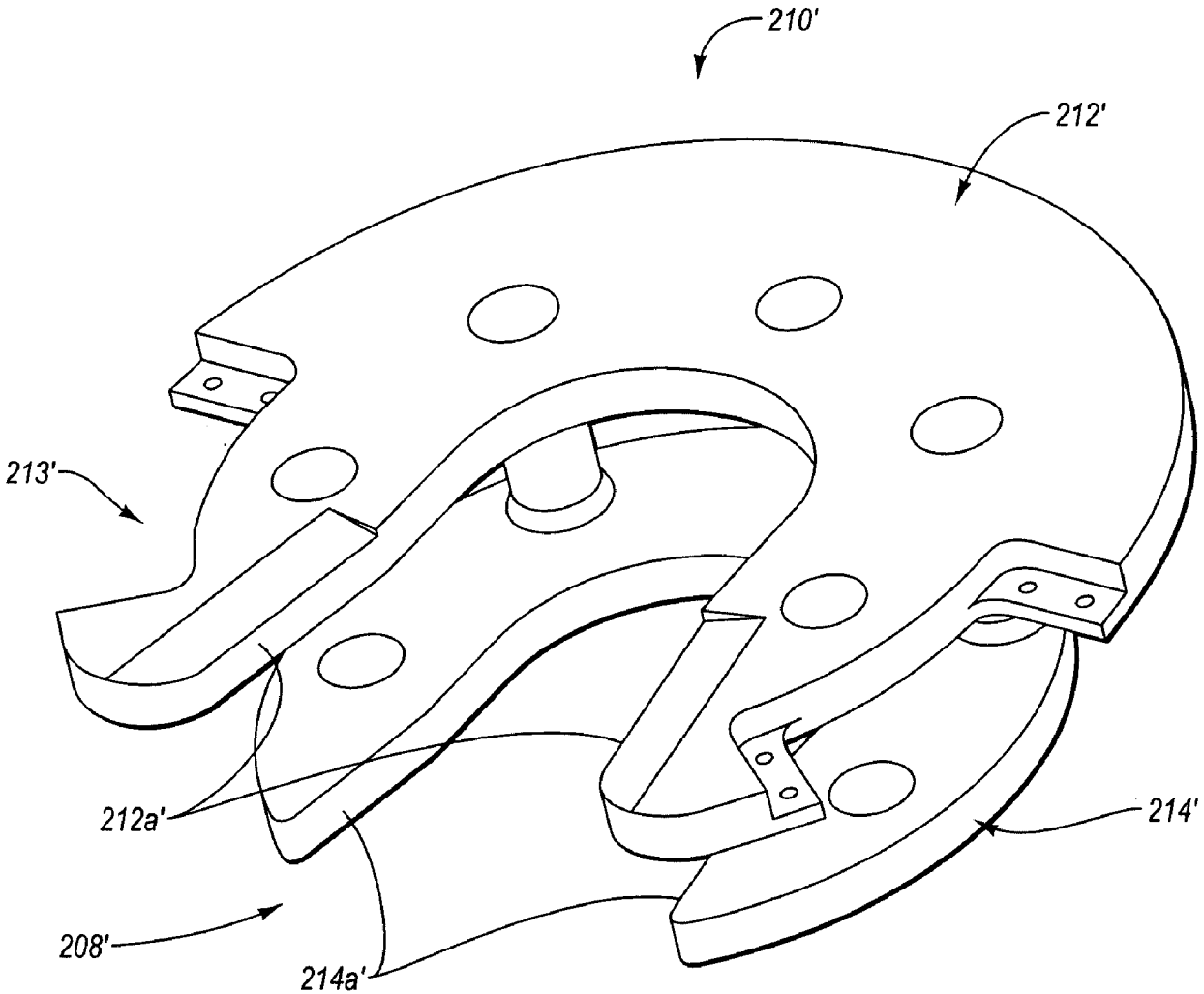
FIG. 10 discloses an additional example carriage assembly of an open-faced rod-spinning device in accordance with an implementation of the present disclosure.

Reference is now made to FIG. 10, which illustrates a further embodiment of an example carriage assembly 210' in accordance with an additional implementation of the present disclosure. The example carriage assembly 210' of this configuration may be functionally similar to the example carriage assembly 210 previously described above and shown in FIGS. 1-9 in most respects, wherein certain features will not be described in relation to this configuration wherein those components may function in the manner as described above and are hereby incorporated into this additional configuration described below. Like structures and/or components may be given like reference numerals.

In one embodiment, the carriage assembly 210' may have a flared open face 208' have a flared opening to facilitate engagement of a drill rod. In particular, the top plate 212' and bottom plate 214' may each include an open face with flared edges 212*a*', 214*a*'. For example, the flared edges 212*a*', 214*a*' may provide a wider dimension near the mouths of the openings in order to more easily receive a drill rod into the carriage assembly 210'. In one embodiment, the flared edges 212*a*', 214*a*' may facilitate engaging a drill rod into a rod-spinning device (i.e., 200, FIG. 3) even if there is some misalignment between the openings of the carriage assembly 210', the drive gear (i.e., 226, FIG. 4) and/or the rod-spinning device (i.e., 200, FIG. 3). As a result, the flared opening 208' of the carriage assembly 210' may reduce the rotational precision necessary to engage a drill rod without sacrificing the utility of the carriage assembly 210'.

In a further embodiment, the top plate 212' of the carriage assembly may include one or more gaps 213' for receiving a mounting plate (i.e., 240, FIG. 8) configured to assist in maintaining the alignment of one or more gripping lobes (i.e., 218, FIG. 5) as described in more detail above.

Figure 11:
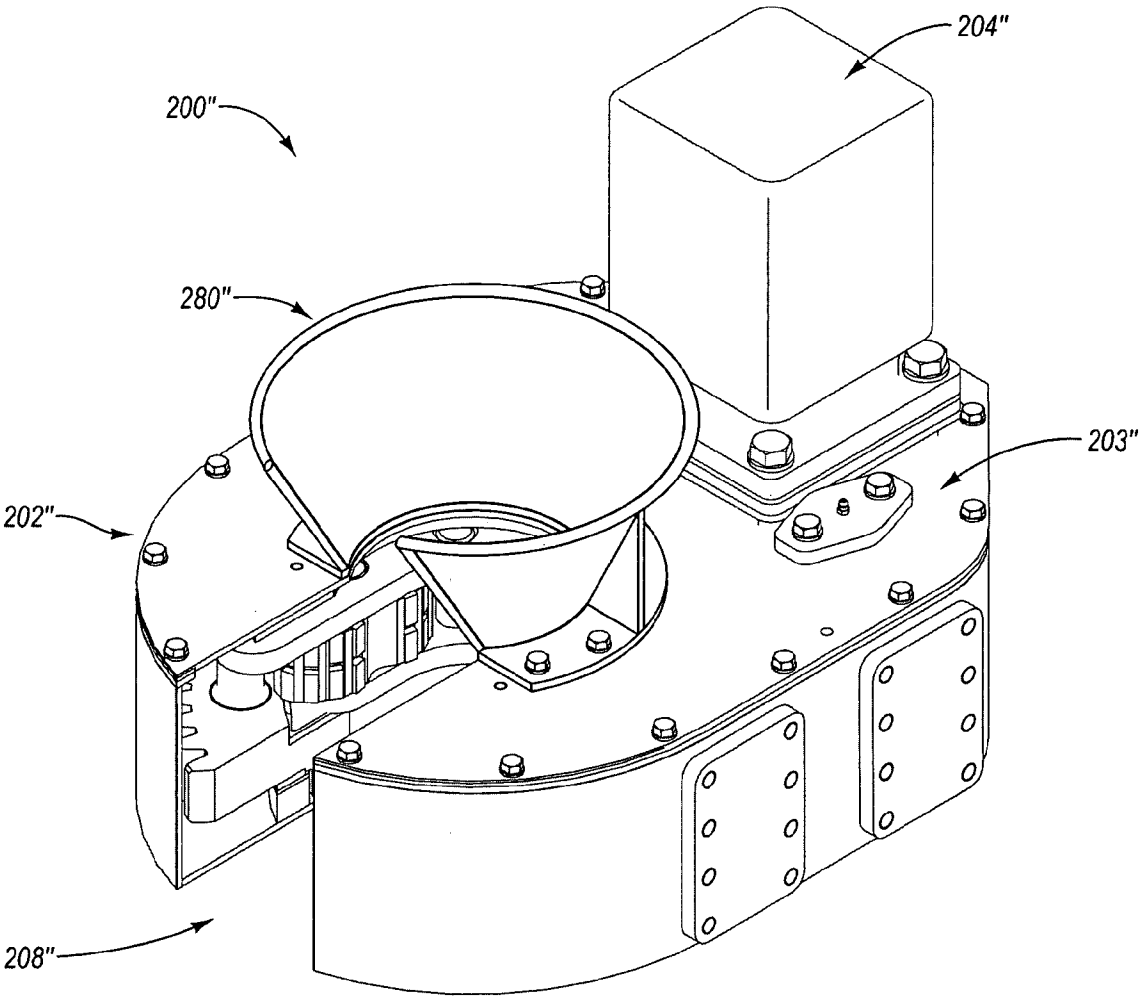
FIG. 11 discloses an additional example open-faced rod-spinning device in accordance with an implementation of the present disclosure.

Reference is now made to FIG. 11, which illustrates an additional example embodiment of a rod-spinning device 200" in accordance with the present disclosure. The example rod-spinning device 200" of this configuration may be functionally similar to the rod-spinning device 200 previously described above and shown in FIGS. 1-7 and 9 in most respects, wherein certain features will not be described in relation to this configuration wherein those components may function in the manner as described above and are hereby incorporated into this additional configuration described below. Like structures and/or components may be given like reference numerals.

In one embodiment, the rod-spinning device 200" may include a collar 280" coupled to the casing 202". As illustrated, the open face 208" of the rod-spinning device 200"

may extend to the collar 280" to facilitate engaging and/or releasing a drill rod. In one embodiment, the collar 280" may couple to the casing cover 203" on top of the rod-spinning device 200". In a further embodiment, the collar 280" may couple to any location of the rod-spinning device 200". In a yet further embodiment, a plurality of collars 280" may be used. For example, in one embodiment, one collar 280" may be positioned on top of the rod-spinning device 200" and one collar 280" may be positioned on bottom of the rod-spinning device 200".

Figure 12:
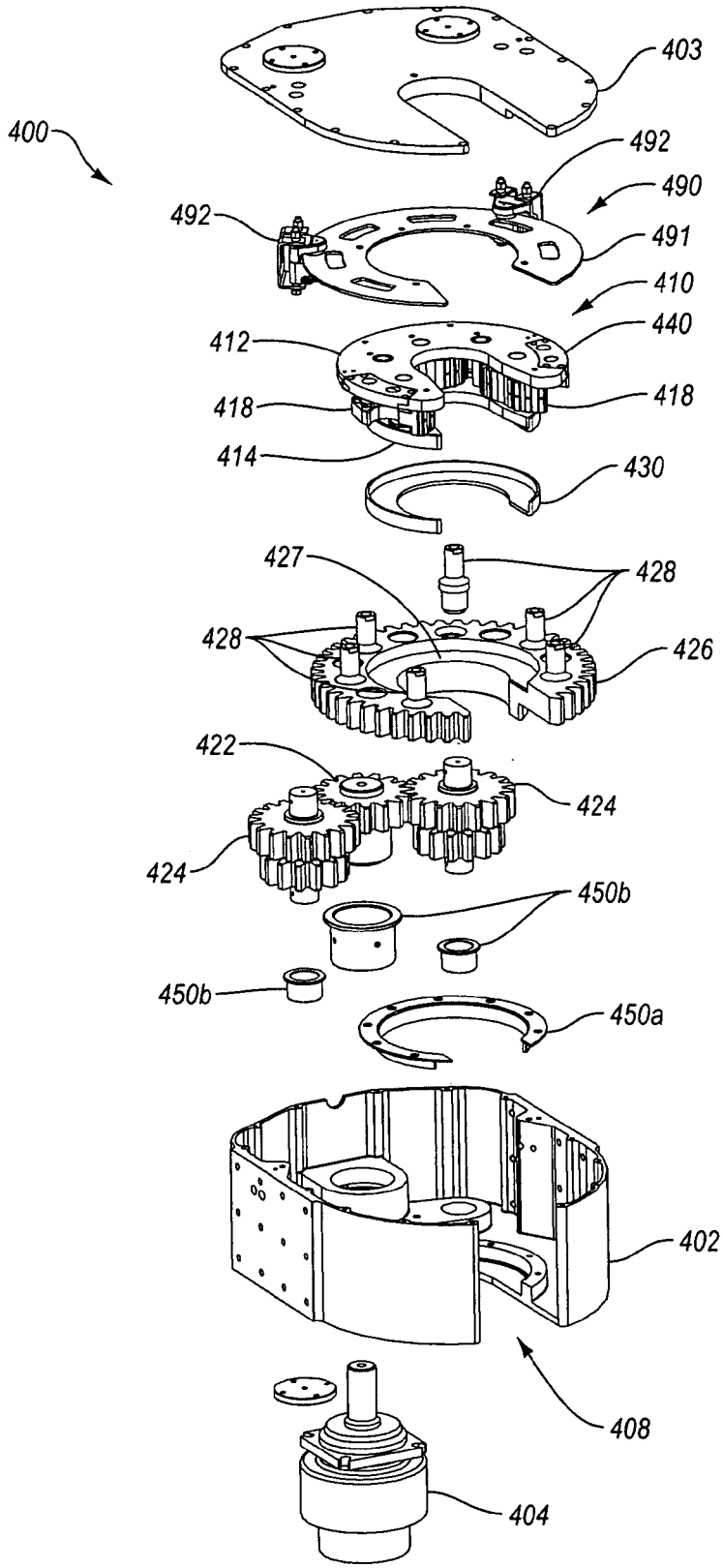
FIG. 12 discloses an exploded view of a further example open-faced rod-spinning device in accordance with an implementation of the present disclosure.

Reference is now made to FIG. 12, which illustrates an exploded view of an additional example rod-spinning device 400 in accordance with an implementation of the present disclosure. The example rod-spinning device 400 of this configuration may be functionally similar to the rod-spinning devices 200, 200" previously described above and shown in FIGS. 1-7, 9, and 11 in most respects, wherein certain features will not be described in relation to this configuration wherein those components may function in the manner as described above and are hereby incorporated into this additional configuration described below. Like structures and/or components may be given like reference numerals.

In one embodiment, the rod-spinning device 400 may include a casing 402 and casing cover 403 that at least partially enclose one or more components of the rod-spinning device 400. In particular, the casing 402 and casing cover 403 may at least partially enclose one or more gear bearings 450 that facilitate the rotation of one or more pinion gears 422, idler gears 424, and/or drive gears 426. The drive gear 426 may be coupled to one or more drive pins 428. For example, the drive pins 428 may be disposed within one or more recesses within the drive gear 426. The drive pins 428 may also be configured to drive one or more gripping lobes 418 of a carriage assembly 410.

The carriage assembly 410 may include a top plate 412 and bottom plate 414 with the one or more gripping lobes 418 disposed therebetween. The carriage assembly 410 may further include one or more pivot pins connecting the top plate 412 to the bottom plate 414 and about which the one or more gripping lobes 418 may rotate. The carriage assembly 410 may be configured to rotate relative to the drive gear 426. In particular, the carriage assembly 410 may be disposed within a recess 427 in the drive gear 426 configured to allow rotation of the carriage assembly 410 relative to the drive gear 426. In addition, a carriage assembly bearing 430 may be positioned within the recess 427 between the carriage assembly 410 and drive gear 426 to facilitate the relative rotation of the carriage assembly 410.

The rod-spinning device 400 may further include a braking mechanism 490. In particular, the braking mechanism 490 may include a braking disc 491 and one or more braking calipers 492 operatively associated with the braking disc 491. The braking disc 491 may be coupled to the top plate 412 of the carriage assembly 410. The braking calipers 492 may be fixed in place, and the braking disc 491 may be configured to rotate and/or otherwise move relative to the braking calipers 492. For example, the braking calipers 492 may be connected to the casing 402 or casing cover 403 and the braking disc 491 may be connected to and rotate with the top plate 412 of the carriage assembly 410. Accordingly, an operator may activate the braking calipers 492 in order to prevent rotation of the braking disc 491 and carriage assembly 410 when it is desired to prevent the carriage assembly 410 from rotating. In a further embodiment, the operator may selectively engage and disengage the braking calipers 492 in order to selectively hold and release the braking disc 491 and carriage assembly 410.

Figure 13:
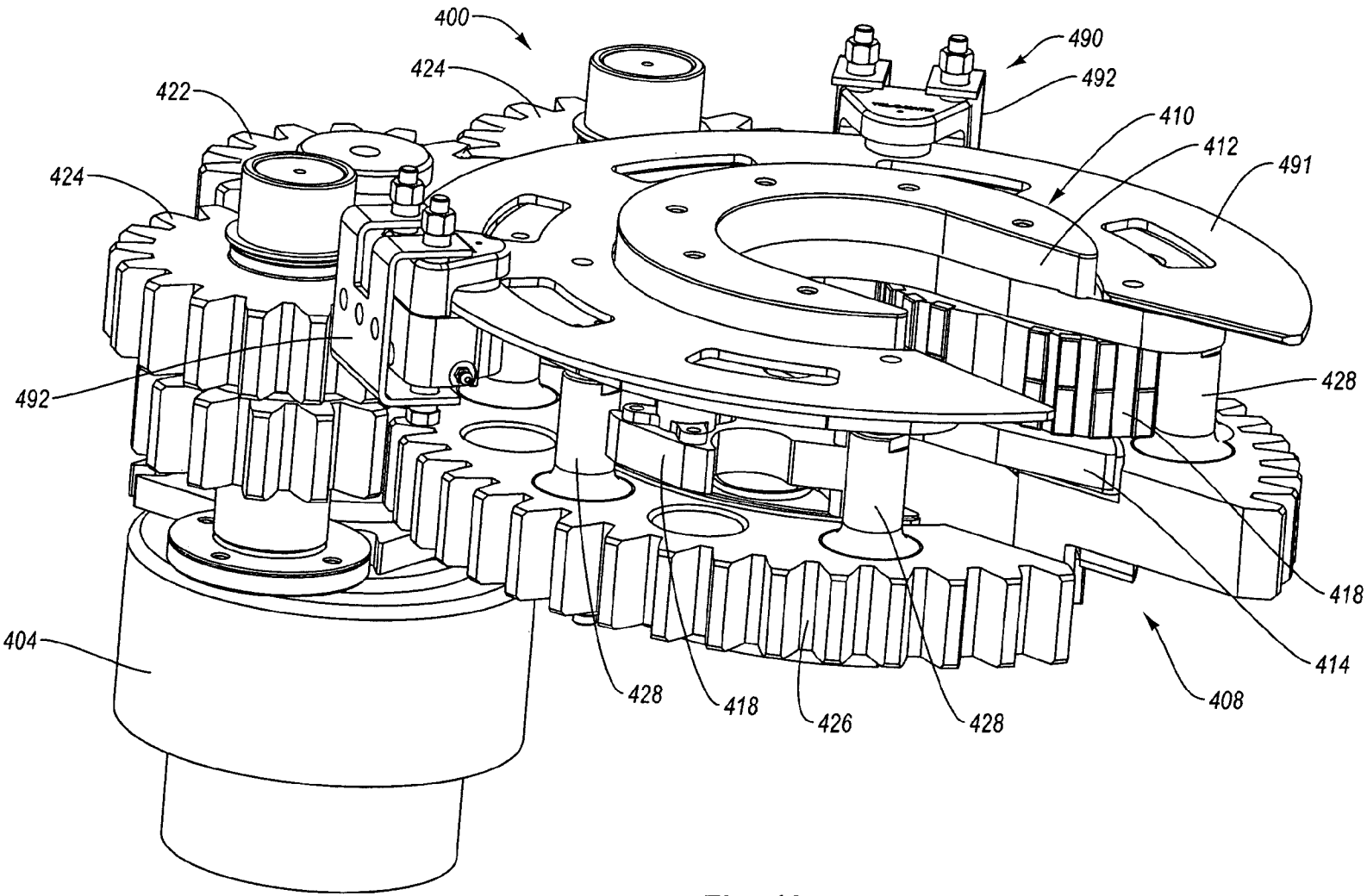
FIG. 13 discloses an example drive pin in accordance with an implementation of the present disclosure.

With continued reference to FIG. 12, reference is now made to FIG. 13, which discloses various components of the example rod-spinning device 400 in more detail. In particular, FIG. 13 discloses the assembled motor 404, pinion gear 422, idler gears 424, drive gear 426, drive pins 428, carriage assembly 410, and braking mechanism 490 in accordance with an example implementation of the present disclosure.

As shown, the braking mechanism 490 may be coupled to the carriage assembly 410. In particular, the braking disc 491 may be connected to the top plate 412 of the carriage assembly 410. In turn, the braking calipers 492 may be connected to a casing 402 or casing cover 403 or other component. The braking disc 491 may be disposed at least partially within the braking calipers 492, such that activation of the braking calipers 492 applies a pressure and/or frictional force on the braking disc 491 to prevent or resist movement by the braking disc 491 and carriage assembly 410 relative to the braking calipers 492. Accordingly, activating the braking calipers 492 may at least partially prevent the braking disc 491 and carriage assembly 410 from rotating.

The braking calipers 492 and braking disc 491 may include any number of materials. For example, the braking calipers 492 and braking disc may include metals, composites, plastics, other similar materials, and/or combinations of the same. In addition, the braking calipers may be configured to be activated with any of a number of different instrumentalities. For example, the operator may active the braking calipers 492 using pneumatics, hydraulics, electricity, magnetic forces, mechanical forces, other similar instrumentalities, and/or combinations of the same.

A manufacturer may connect the braking disc 491 to the carriage assembly 410 using any number of fastening techniques. For example, the manufacture may connect the braking disc 491 to the carriage assembly using bolts, welds, adhesives, other fasteners, and/or combinations of the same. In a further embodiment, the braking disc 491 may be an integral part of the top plate 412 of the carriage assembly 410.

A manufacturer may also configure the rod-spinning device 400 to resist relative motion between the carriage assembly 410 and drive gear 426. For example, in one implementation, one or more drive pins 428 may include a detent mechanism configured to resist movement between the carriage assembly 410 and drive gear 426. In particular, the detent mechanism may include a detent member that is configured to extend upwards from the top of a drive pin 428 and move longitudinally, back and forth relative to the drive pin 428. The detent member may also extend towards the bottom surface of the top plate 412 of the carriage assembly 410. The top plate 412 may further include one or more corresponding indentations or holes configured to at least partially receive the detent member. The detent mechanism may be further configured to apply an upward force to the detent member so as to push the detent member into an indentation in the top plate 412 and resist relative movement between the drive pin 428 and top plate 412 of the carriage assembly 410.

Figure 14:
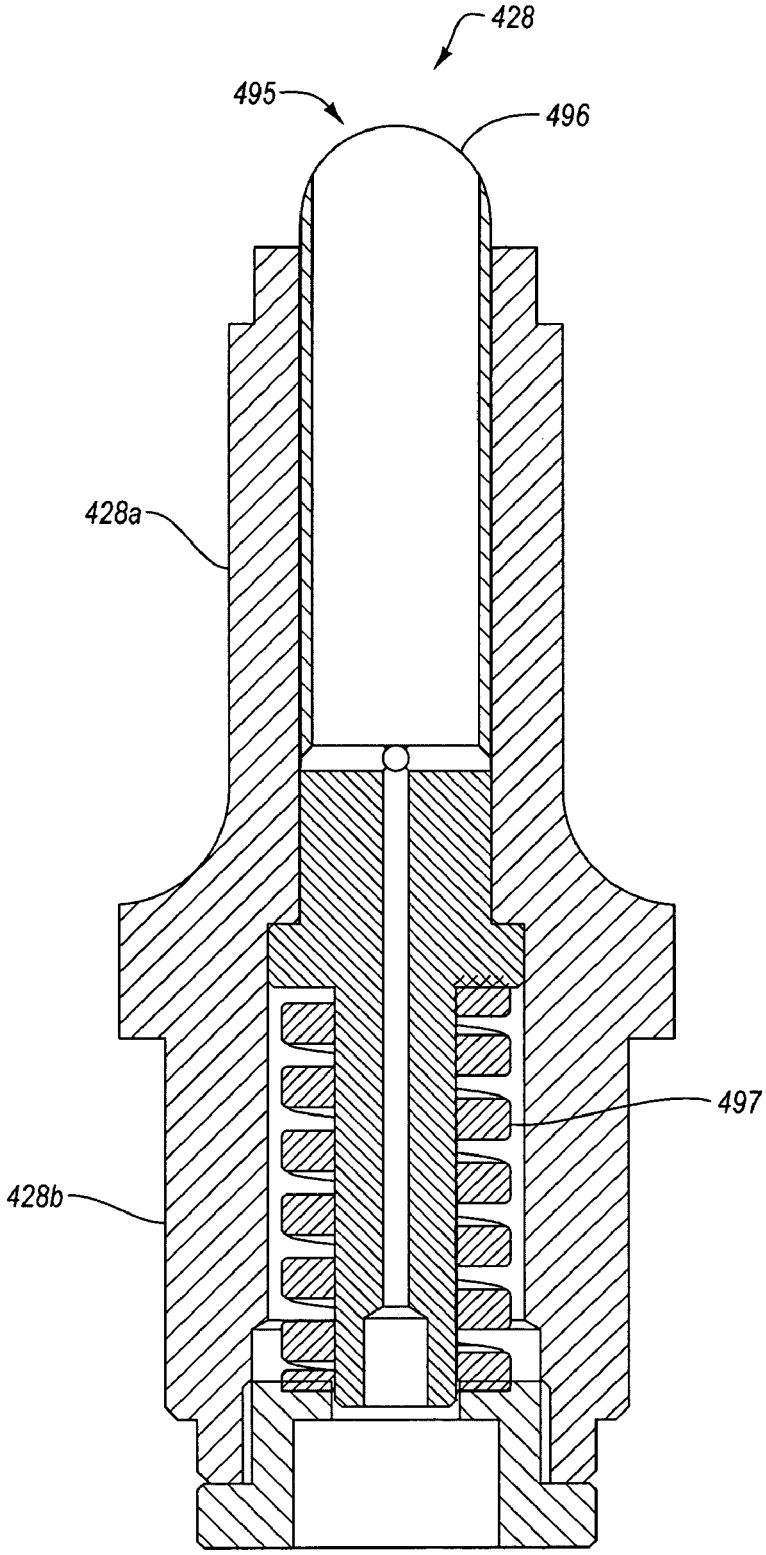
FIG. 14 discloses various components of the example open-faced rod-spinning device of FIG. 12 in accordance with an implementation of the present disclosure.

With continued reference to FIGS. 12 and 13, reference is now made to FIG. 14, which discloses an example drive pin 428 including an example detent mechanism 495. In particular, the drive pin 428 has a pin portion **428*a* and a base portion 428*b*. The pin portion 428*a* may be configured to engage, rotate, and/or drive a gripping lobe 418. The base portion 428*b* may be configured to be disposed within a corresponding recess in a drive gear 426**.

In one implementation, the drive pin 428 may include a detent mechanism 495. The detent mechanism may include a detent member 496 movable relative to the drive pin 428 and extending upward from the pin portion **428*a*. The shape, size, and configuration of the detent member 496 may be configured to be received by a corresponding indentation or hole in the top plate 412 of the carriage assembly 410. For example, the detent member 496 may have one end that is rounded in shape. In further implementations, the detent member 496** may have any shape, size, and/or configuration desired for a particular application.

The detent mechanism 495 may be further configured to provide an upward force on the detent member 496 in order to move the detent member 496 in a longitudinal direction into an indentation of the top plate 412 to resist movement between the drive pin 428 and top plate 412, and thereby resist movement between the drive gear 426 and carriage assembly 410. For example, the detent mechanism 495 may include a spring 497 that applies a constant force to the detent member 496. In a further implementation, the drive pins 428 and/or indentations in the top plate 412 may be positioned such that the indentations receive the detent members 496 when the openings of the drive gear 426 and carriage assembly 410 are in alignment.

In further embodiments, the detent mechanism 495 may be configured to apply selective forces to the detent member 496. For example, the detent mechanism 495 may be configured to apply selective hydraulic, mechanical, pneumatic, magnetic, electrical, and/or other forces to the detent member 496. As a result, an operator may selectively activate the force on the detent member 496 when she desires to resist movement between the drive gear 426 and the carriage assembly 410 and deactivate the force on the detent member 496 when she desires to allow relative movement between the drive gear 426 and carriage assembly 410. In a yet further implementation, the detent mechanism 495 may be configured to retract the detent member 496 when relative movement between the drive gear 426 and carriage assembly 410 is desired.

Any number of the drive pins 428 may include a detent mechanism 495. For example, in one implementation, as many as all of the drive pins 428 and as few as one drive pin 428 may include a detent mechanism 495. In a further example, two drive pins 428 may each include a detent mechanism 495 while the remaining drive pins 428 do not.

As a result, and with continued reference to FIGS. 12-14, an operator may make or break a drill rod joint with the example rod-spinning device 400. For example, the rod-spinning device 400 may begin in a first position in which the carriage assembly 410 and drive gear 426 are aligned with the open face 408 of the casing 402 in order to receive a drill rod. Once the rod-spinning device 400 receives a drill rod, the operator may activate the motor 404 to begin to rotate the drive gear 426 in the desired direction.

The braking calipers 492 may apply pressure to the braking disc 491 in order to maintain the carriage assembly 410 stationary as the drive gear 426 begins to rotate. In so doing, the torque applied to the drive gear 426 in conjunction with the friction applied by the braking mechanism 490 may overcome the resistance to relative movement between the carriage assembly 410 and drive gear 426 created by the detent mechanisms 495 of the drive pins 428. The relative rotation of the drive gear 426 with respect to the carriage assembly 410 may cause the drive pins 428 to engage and rotate the gripping lobes 418 until they engage the drill rod. Once the gripping lobes 418 engage the drill rod, the braking calipers 492 may deactivate as the drive gear 426 continues to rotate in order to allow the drive gear 426, carriage assembly 410, and drill rod to rotate together to make or break a joint in a drill rod string.

Once the drill rod joint is either made or broken as desired, the braking calipers 492 may activate and apply pressure to the braking disc 491 to resist movement of the carriage assembly 410 and facilitate relative movement between the carriage assembly 410 and the drive gear 426. The operator may then reverse the motor 404 in order to reverse the direction of and rotate the drive gear 426 until the open face of the drive gear 426 aligns with the open face of the carriage assembly 410. As the drive gear 426 and carriage assembly 410 are aligned, the detent member 496 of the detent mechanism 495 may be received by the indentations in the top plate 412 of the carriage assembly 410 to thereby resist further relative movement between the drive gear 426 and the carriage assembly 410. Once the drive gear 426 and carriage assembly 410 are aligned, the braking calipers 492 may deactivate to release the braking disc 491 to allow the carriage assembly 410 to rotate with the drive gear 426. The operator may further reverse the motor 404 in order to align the openings of the carriage assembly 410 and drive gear 426 with the open face 408 of the casing 402 in order to release the drill rod.

In order to facilitate this process, the braking mechanism 490 may further include a timing device that selectively activates and deactivates the braking calipers 492. For example, in one implementation, the braking mechanism 490 may include a hydraulic timer that selectively activates and deactivates the braking calipers 492 when desired to resist movement of the braking disc 491 and carriage assembly 410. In particular, the hydraulic timer may apply hydraulic pressure to and relieve hydraulic pressure from the braking calipers 492 at appropriate times during the process of making and breaking drill rod joints in order to ensure the proper relative rotation between the drive gear 426 and carriage assembly 410. In a further implementation, the timing device, such as a hydraulic timer, may automatically activate and deactivate at appropriate times during the process of making and breaking drill rod joints.

In one example, the hydraulic timer may include a variable flow controller in series with an accumulator. An operator may adjust the flow controller to control the time it takes for the accumulator to fill with fluid. As the accumulator fills with fluid, pressure may increase in the accumulator. Once fluid pressure within the accumulator achieves a particular level, it may trigger a sequence valve, which then allows pressure to be applied to a pilot-operated check valve, which, when opened, releases pressure from and deactivates the braking calipers 492. An operator may adjust flow through the flow controller and the pressure of the sequence valve in order to achieve the desired timing of activation and deactivation of the braking calipers 492.

The rod-spinning device 400 may further include a switch that automatically deactivates or applies a brake to the motor 404 once the drive gear 426 and carriage assembly 410 are aligned with the open face 408 of the casing 402. For example, the rod-spinning device 400 may include a directional control valve coupled to the motor 404 to stop rotation of the motor 404 once the drive gear 426 and carriage assembly 410 are aligned with the open face 408 of the casing 402.

Figure 15:
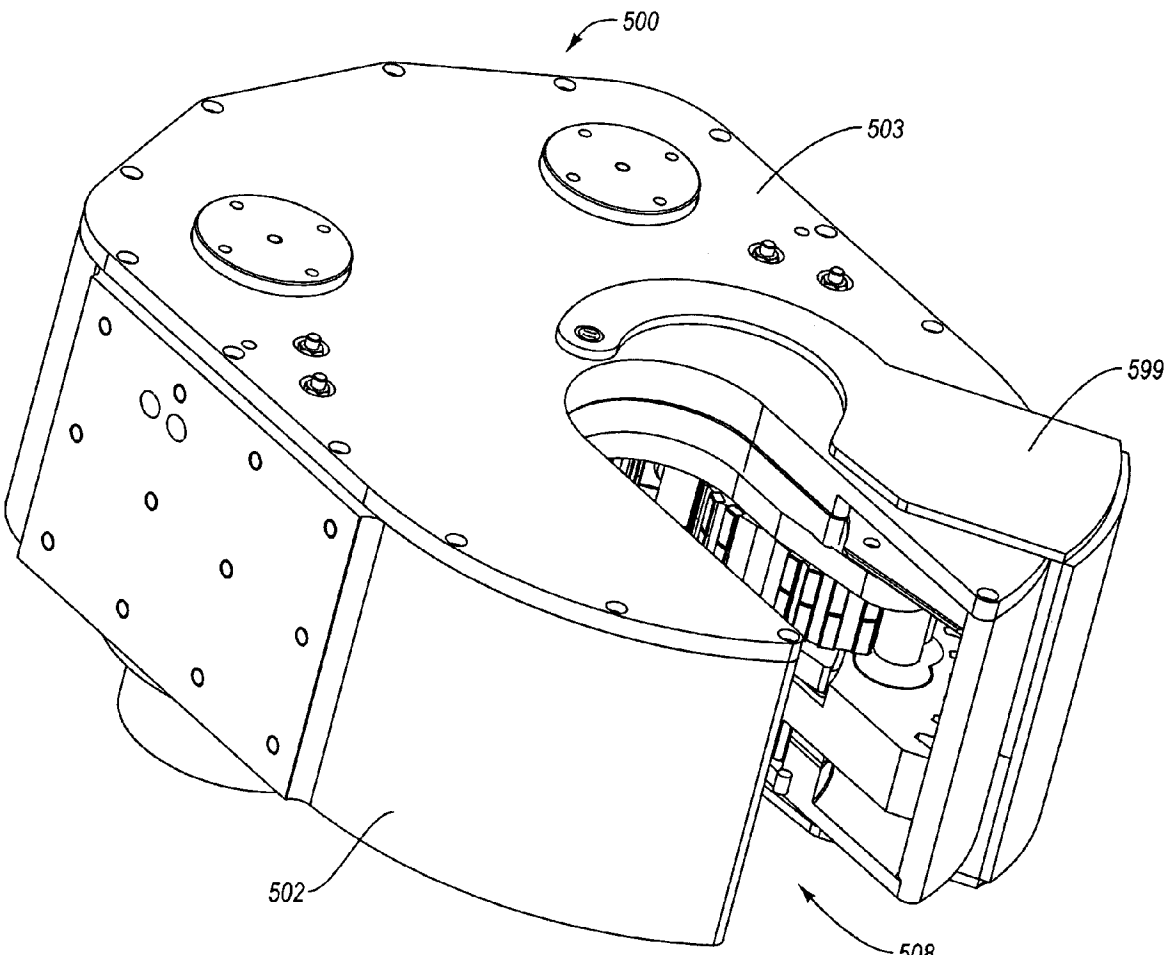
FIG. 15 discloses a yet further example open-faced rod-spinning device in accordance with an implementation of the present disclosure.

Reference is now made to FIG. 15, which illustrates a further example rod-spinning device 500 in accordance with an implementation of the present disclosure. The example rod-spinning device 500 of this configuration may be functionally similar to the rod-spinning devices 200, 200", 400 previously described above and shown in FIGS. 1-7, 9, and 11-14 in most respects, wherein certain features will not be described in relation to this configuration wherein those components may function in the manner as described above and are hereby incorporated into this additional configuration described below. Like structures and/or components may be given like reference numerals.

In one embodiment, the rod-spinning device 500 may include a gate 599 configured to at least partially close the open face 508 of the casing 502 and casing cover 503. In particular, the gate 599 may be configured to at least partially cover the open face 508 to protect the inner components of the rod-spinning device 500 and to prevent any unwanted objects from becoming caught in the rod-spinning device 500. The gate 599 may be coupled to a closing mechanism in order to selectively open and close the gate 599 as desired. For example, the gate 599 may be coupled to a hydraulic device configured to close and open the gate 599 as desired during the process of making or breaking a drill rod joint. Accordingly, the gate 599 may improve the integrity and safety of the rod-spinning device.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

We claim:

1. An open-faced rod-spinning device for making and breaking joints of a drill rod, comprising:

a drive gear including an open face;

a plurality of drive pins coupled to said drive gear;

a carriage assembly including an open face, said carriage assembly being rotatably coupled to said drive gear;

at least one pivot pin extending from said carriage assembly;

at least one gripping lobe coupled to said at least one pivot pin, said at least one gripping lobe having first and second gripping surfaces symmetrically positioned relative to said at least one pivot pin;

a first drive pin positioned on a first side of said at least one gripping lobe; and a second drive pin positioned on a second side of said at least one gripping lobe;

wherein upon rotation of said drive gear in a first direction, said first drive pin engages and pivots said at least one gripping lobe about said at least one pivot pin causing said first gripping surface of said at least one gripping lobe to contact the drill rod;

wherein upon rotation of said drive gear in a second direction, said second drive pin engages and pivots said at least one gripping lobe about said at least one pivot pin causing said second gripping surface of said at least one gripping lobe to contact the drill rod.

2. The open-faced rod-spinning device as recited in claim 1, wherein said at least one gripping lobe includes an eccentrically shaped head end, a waist, and a flared tail end.

3. The open-faced rod-spinning device as recited in claim 2, wherein said at least one gripping lobe further comprises one or more indentations proximate said waist, each indentation being configured to receive a drive pin.

4. The open-faced rod-spinning device as recited in claim 1, further comprising a casing including an open face configured for receiving the drill rod, wherein said casing houses a gear system and said carriage assembly.

5. The open-faced rod-spinning device as recited in claim 4, wherein said first and second drive pins are adapted to engage said waist of said at least one gripping lobe.

6. The open-faced rod-spinning device as recited in claim 5, wherein each of said first and second gripping surfaces includes a plurality of gripping elements.

7. The open-faced rod-spinning device as recited in claim 6, wherein said gripping elements comprise tungsten carbide inserts.

8. The open-faced rod-spinning device as recited in claim 6, wherein said gripping elements comprise teeth-like protrusions.

9. The open-faced rod-spinning device as recited in claim 4, further comprising a gate configured to at least partially close said open face of said casing.

10. The open-faced rod-spinning device as recited in claim 1, further comprising a hydraulic motor configured to drive said drive gear.

11. The open-faced rod-spinning device as recited in claim 10, further comprising a pinion gear configured to be driven by said hydraulic motor.

12. The open-faced rod-spinning device as recited in claim 11, further comprising a plurality of idler gears configured to be driven by said opinion gear and in turn drive said drive gear.

13. The open-faced rod-spinning device as recited in claim 10, wherein a torque output of said hydraulic motor is configured to be adjusted to achieve specified torques in the drill rod.

14. The open-faced rod-spinning device as recited in claim 1, wherein said carriage assembly further comprises a top plate and a bottom plate, each including an open face for receiving the drill rod.

15. The open-faced rod-spinning device as recited in claim 14, wherein said at least one pivot pin is coupled at one end to said top plate and at another end to said bottom plate.

16. The open-faced rod-spinning device as recited in claim 14, further comprising a first magnet with a first polarity coupled to said at least one gripping lobe and a second magnet with a second polarity opposite said first polarity coupled to said top or bottom plate of said carriage assembly, said second magnet being configured to attract said first magnet and thereby rotate said at least one gripping lobe from a misaligned position to an aligned position.

17. The open-faced rod-spinning device as recited in claim 1, further comprising a friction element configured to selectively apply a frictional force to said carriage assembly to facilitate independent rotation of said drive gear relative to said carriage assembly.

18. The open-faced rod-spinning device as recited in claim 1, further comprising a bearing located between said carriage assembly and said drive gear, wherein said bearing is configured to facilitate relative rotation between said carriage assembly and said drive gear.

19. The open-faced rod-spinning device as recited in claim 1, wherein said carriage assembly includes three or more gripping lobes.

20. The open-faced rod-spinning device as recited in claim 1, wherein said carriage assembly is at least partially positioned in a recess defined by said drive gear.

21. The open-faced rod-spinning device as recited in claim 1, wherein said open-faced rod-spinning device is configured to engage a range of drill rod sizes from B-sized drill rods to P-sized drill rods.

22. The open-faced rod-spinning device as recited in claim 1, further comprising one or more alignment devices configured to rotate said at least one gripping lobe away from a misaligned position to an aligned position.

23. The open-faced rod-spinning device as recited in claim 22, wherein said one or more alignment devices comprise one or more magnets.

24. The open-faced rod-spinning device as recited in claim 1, wherein the open face of said carriage assembly has one or more flared edges to facilitate receiving the drill rod.

25. The open-faced rod-spinning device as recited in claim 1, further comprising a braking mechanism configured to resist rotation of said carriage assembly.

26. The open-faced rod-spinning device as recited in claim 25, wherein said braking mechanism comprises a braking disc coupled to said carriage assembly and one or more braking calipers operatively associated with said braking disc.

27. The open-faced rod-spinning device as recited in claim 1, further comprising a detent mechanism configured to resist relative movement between said carriage assembly and said drive gear.

28. The open-faced rod-spinning device as recited in claim 27, wherein said detent mechanism resists relative movement between said carriage assembly and said drive gear when said carriage assembly and said drive gear are in alignment.

29. An open-faced rod-spinning device comprising:

a drive gear including an open face;

a plurality of drive pins coupled to the drive gear;

a carriage assembly including an open face;

a plurality of gripping lobes secured to the carriage assembly;

a first magnet with a first polarity coupled to a gripping lobe and a second magnet with a second polarity opposite the first polarity coupled to the carriage assembly, the second magnet being configured to attract the first magnet and thereby rotate the gripping lobe from a misaligned position to an aligned position;

and a third magnet with a third polarity equal to the first polarity coupled to the carriage assembly, the third magnet being configured to repel the first magnet and thereby rotate the gripping lobe away from a misaligned position;

wherein the drive gear is configured to selectively rotate independent of the carriage assembly to cause at least one of the plurality of drive pins to engage and rotate at least one of the plurality of gripping lobes.

30. A drill mast adapted to support a drill string formed from one or more drill rods, comprising:

a support structure;

an open-faced rod-spinning device coupled to said support structure and configured for making and breaking connections between threaded drill rods of the drill string, wherein said open-faced rod spinner comprises:

a gear system having an open face;

a carriage assembly having an open face, said carriage assembly being rotatably coupled to said drive system and comprising a plurality of pivot pins;

a plurality of drive pins coupled to said gear system;

a plurality of gripping lobes coupled to said plurality of pivot pins, each gripping lobe including first and second gripping surfaces positioned symmetrically relative to a pivot pin;

a first set of said plurality of drive pins positioned on a corresponding first side of said plurality of gripping lobes; and a second set of said plurality of drive pins positioned on a corresponding second side of said plurality of gripping lobes;

wherein:

said gear system is configured to rotate independent of said carriage assembly, rotation of said gear system in a first direction causes said first set of drive pins to engage and rotate said plurality of gripping lobes into contact with the drill string, and rotation of said gear system in a second direction causes said second set of drive pins to engage and rotate said plurality of gripping lobes into contact with the drill string; and a clamping device coupled to said support structure and configured to selectively clamp the drill string.

31. The drill mast as recited in claim 30, further comprising a hydraulic motor to drive said gear system and said carriage assembly.

32. The drill mast as recited in claim 30, wherein said open-faced rod-spinning device is retractably coupled to said support structure and configured to be moved over a drill string centerline to make or break a drill rod joint and then retracted away from the drill string when not in use.

33. The drill mast as recited in claim 30, wherein said open-faced rod-spinning device is further configured to vertically rotate away from the drill string when not in use.

34. The drill mast as recited in claim 30, wherein said open-faced rod- spinning device is further configured to float up or down relative to said support structure as a drill rod joint is being made or broken.

35. The drill mast as recited in claim 30, wherein said carriage assembly further comprises a top plate and bottom plate connected by said plurality of pivot pins.

* * * * *

UNITED STATES PATENT AND TRADEMARK OFFICE

CERTIFICATE OF CORRECTION

PATENT NO. : 8,006,590 B2
APPLICATION NO. : 12/464707
DATED : August 30, 2011
INVENTOR(S) : Light et al.

It is certified that error appears in the above-identified patent and that said Letters Patent is hereby corrected as shown below:

Column 5
Line 9, change "drill rig 1100" to --drill rig 100--

Column 9
Line 40, change "shape" to --shaped--

Column 11
Line 20, change "top plate 214" to --top plate 212--

Column 12
Line 33, change "have" to --having--

Column 13
Line 9, change "on bottom" to --on the bottom--

Column 14
Line 27, change "active" to --activate--

Column 18
Line 19, change "opinion gear" to --pinion gear--

Signed and Sealed this
Thirteenth Day of December, 2011

David J. Kappos

David J. Kappos
*Director of the United States Patent and Trademark Office*